US005992290A

United States Patent [19]

Quebedeaux et al.

[11] Patent Number: 5,992,290

[45] Date of Patent: Nov. 30, 1999

[54] AIRCRAFT INTERFACE DEVICE AND CROSSOVER CABLE KIT

[75] Inventors: Gayle P. Quebedeaux, Powey; James W. Schafer; Gerald R. Schroeder, both of San Diego, all of Calif.

[73] Assignee: Cubic Defense Systems, Inc., San Diego, Calif.

[21] Appl. No.: 08/968,506

[22] Filed: Nov. 12, 1997

Related U.S. Application Data

[60] Provisional application No. 60/041,840, Apr. 9, 1997.

[51] Int. Cl.[6] ..... B64D 1/04

[52] U.S. Cl. ..... 89/1.56; 89/1.51

[58] Field of Search ..... 89/1.51, 1.55, 89/1.56, 1.8; 235/401, 402, 400; 434/14, 15; 102/206

[56] References Cited

U.S. PATENT DOCUMENTS

| | | | |
|---|---|---|---|
| 3,779,129 | 12/1973 | Lauro | 89/1.56 |
| 4,494,438 | 1/1985 | Lighton et al. | 89/1.813 |
| 4,894,522 | 1/1990 | Elliot | 235/472 |
| 5,034,686 | 7/1991 | Aspelin | 324/158.1 |
| 5,036,465 | 7/1991 | Ackerman, Jr. et al. | 235/400 |
| 5,036,466 | 7/1991 | Fitzgerald et al. | 235/400 |
| 5,229,538 | 7/1993 | McGlynn et al. | 89/1.56 |
| 5,349,685 | 9/1994 | Houlberg | 395/800.4 |
| 5,377,109 | 12/1994 | Baker et al. | 701/14 |
| 5,541,839 | 7/1996 | Mitzkus et al. | 244/3.16 |
| 5,566,349 | 10/1996 | Trout | 395/840 |
| 5,591,031 | 1/1997 | Monk et al. | 434/14 |
| 5,614,896 | 3/1997 | Monk et al. | 340/945 |
| 5,721,680 | 2/1998 | Van Cleve et al. | 244/3.11 |

OTHER PUBLICATIONS

Organizational Maintenance System Schematics—Armament Computer Input/Output Interface Stores Management System, document A1–F18AE–740–500 change 3, pp. 1 and 5–10 (Apr. 1994).

MIL–Q–9858—Quality Program Requirements; Dec. 1963.

MIL–HD–BK–217E—Reliability Prediction of Electronic Equipment, Oct. 1986.

MIL–STD–454—Standard General Requirements for Electronic Equipment Dec., 1983.

MIL–STD–461B—Requirements for the Control of Electromagnetic Interference Emissions and Susceptibility Apr. 1980.

MIL–STD–810D—Environmental Test Methods and Engineering Guidelines Jul., 1989.

MIL–STD–883C—Test Methods and Procedures for Microelectronics Dec. 1989.

MIL–STD–1553—Aircraft Internal Time Division Command/Response Multiplex Data Bus, Sep. 1978.

MIL–STD–454—Standard General Requirements for Electronic Equipment Dec. 1989.

TM 9704–0450—Technical Manual for the Air Combat Training Interface Device.

*Primary Examiner*—Charles T. Jordan
*Assistant Examiner*—Jeffrey Howell
*Attorney, Agent, or Firm*—Michael H. Jester

[57] ABSTRACT

A digital interface device conveys signals between aircraft data busses and a wingtip weapons station. A first interface is provided, coupling to an F/A-18 Aircraft Instrumentation Subsystem Internal (AISI) input/output connector. A second interface is coupled to a secondary armament bus. A crossover cable interconnects the wingtip weapon station to the secondary armament bus. A digital data processing module is coupled to the first and second interfaces and programmed to convey signals between aircraft data systems coupled to the F/A-18 AISI input/output connector and the wingtip weapon station. Namely, the processing module monitors signals received on the input/output connector, and extracts signals addressed to one or more predetermined addresses. The module also transmits the reformatted signals to the wingtip weapon station. With a minimum of wiring changes, the interface easily converts an aircraft designed for a nose-mounted ACT pod for use with an ACT pod mounted at a wingtip station. Another benefit is that the processing module plugs into an existing input/output connector in substitution for a nose-mounted ACT pod.

22 Claims, 23 Drawing Sheets

AIRCRAFT INTERFACE DEVICE AND CROSSOVER CABLE KIT

CROSS-REFERENCE TO RELATED APPLICATIONS

This application is a utility patent application based on provisional application Ser. No. 60/041,840, filed on Apr. 9, 1997 in the names of Gayle P. Quebedeaux et al., and entitled "F-18/ACT-R INTERFACE DEVICE AND CROSSOVER CABLE KIT".

BACKGROUND OF THE INVENTION

1. Field of the Invention

The present invention relates to electronic data systems on aircraft. More particularly, the invention concerns a digital interface device for conveying signals between aircraft data buses and a wingtip weapons station. This device is especially useful because it includes a processing module that couples to an existing input/output connector in substitution for an Aircraft Instrumentation Subsystem Internal (AISI) pod.

2. Description of the Related Art

One useful development in aircraft weapons and data systems has been the air combat training (ACT) pod. Originally, in aircraft such as the F-15, ACT pods were mounted at a weapon station outboard on the wing. The original model of external ACT pod received various data from aircraft systems and transmitted this data to ground stations in proximity of the aircraft. The ACT pod was connected to the aircraft systems by a specially designed assortment of individual wires or digital data buses passing from the aircraft's fuselage to the wingtip station.

Subsequently, engineers associated with the F/A-18 aircraft developed an "internal" ACT pod, contained in the aircraft's nose. Although the internal ACT pod provided more features than the original "external" ACT pod, the antenna coverage of the internal ACT pod is masked during certain flight regimes.

Engineers at Cubic Corporation have recently developed an improved ACT pod known as the air combat training rangeless (ACT-R) pod. The ACT-R pod provides improved performance features with respect to the previous internal and external ACT pods. Furthermore, since the ACT-R pod is designed for mounting at a wingtip station, it avoids antenna masking experienced in the nose-mounted internal ACT pod. However, since the F/A-18 aircraft was designed explicitly for use with a nose-mounted ACT pod, no provision was made for conveying the necessary signals to a wingtip mounted station. Therefore, due to certain unsolved problems, wingtip ACT pods such as the ACT-R pod are not completely adequate for certain uses such as the F/A-18 aircraft.

SUMMARY OF THE INVENTION

Broadly, the present invention concerns a digital interface device for conveying signals between aircraft data buses and a wingtip weapons station. This device includes a first electrical interface coupled to an F-18 Aircraft Internal Instrumentation Subsystem Internal (AISI) input/output connector. A second electrical interface is coupled to a secondary armament bus. A crossover cable interconnects the wingtip weapon stationed to the secondary armament bus. A digital data processing module is coupled to the first and second interfaces and programmed to convey signals between aircraft data systems coupled to the F-18 AISI input/output connector and the wingtip weapon station. Namely, the processing module monitors signals received on the input/output connector, and extracts signals addressed to one or more predetermined addresses. The module also reformats the extracted signals, and transmits the reformatted signals to the wingtip weapon station.

The invention provides a number of distinct advantages. Chiefly, the interface easily converts an aircraft designed for a nose-mounted ACT pod for use with an ACT pod mounted at a wingtip station. The interface includes crossover cables coupled to the aircraft wiring, without requiring any aircraft wiring changes. Conveniently, the processing module plugs into an existing input/output connector in substitution for a nose-mounted ACT pod. The invention also provides a number of other advantages and benefits, which should be apparent from the following description of the invention.

BRIEF DESCRIPTION OF THE DRAWINGS

The nature, objects, and advantages of the invention will become more apparent to those skilled in the art after considering the following detailed description in connection with the accompanying drawings, in which like reference numerals designate like parts throughout, wherein.

DETAILED DESCRIPTION OF THE PREFERRED EMBODIMENTS

1. Introduction

This document defines the internal interfaces required to reconfigure Block 5 and above F-18 aircraft enabling MIL-STD-1553 data to be connected to the Air Combat Training pod installed on wing tip stations 1 and 9. The Air Combat Training Interface Device and Crossover Cable Kit provides the capability to send all pertinent Avionics and Weapons bus data to the wing tip stations. This capability can be provided without aircraft modifications and can be installed or removed in less that 30 minutes.

1.1 General Description

Presently F-18 aircraft do not provide MIL-STD-1553 Mux Bus Data to wing tip stations 1 and 9. This data is required when using Cubic Defense Systems (CDS) Air Combat Training-Rangeless (ACT-R) and Kadena Interim Training System (KITS) pods in training exercises. This allows the pilot multiple weapon shots, and bomb drops in training exercises. There are two alternatives for obtaining this information; one is to make the necessary hardware and software modifications to the aircraft, the other is to use the Air Combat Training Interface Device and Crossover Cable Kit designed by CDS specifically for this application.

Figure 1:
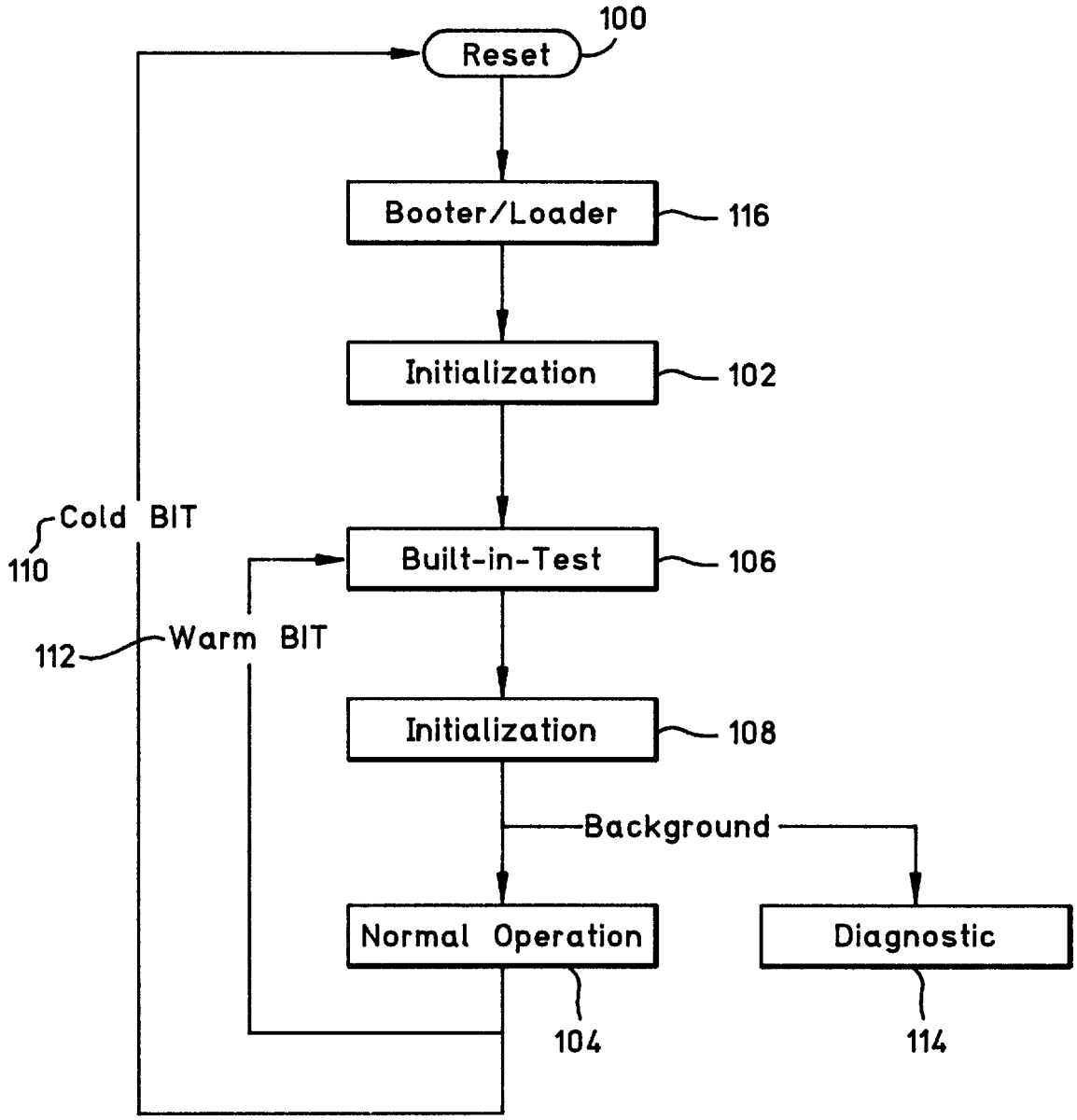
FIG. 1 is a flow chart illustrating software processes in accordance with the invention.
Figure 1A:
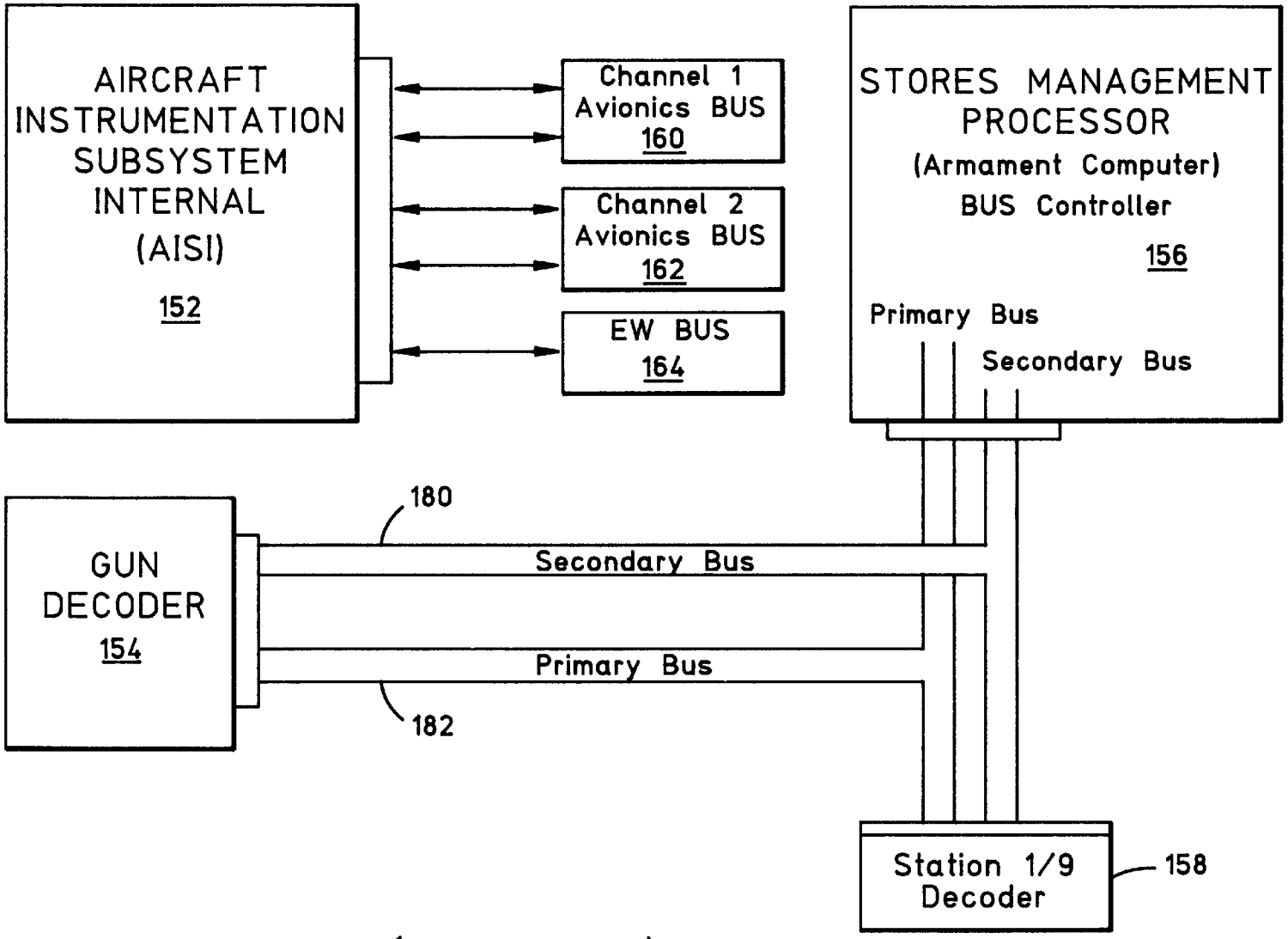
FIG. 1A (PRIOR ART)
FIG. 1A is a block diagram showing an F/A-18 Aircraft Armament Computer Input/Output Interface for the Store Management System, according to the prior art.

1.2 Existing F/A-18 Aircraft Armament Computer Input/Ouput Interface for the Stores Management System FIG. 1A depicts the known F/A-18 Aircraft Armament Computer Input/Ouput Interface for the Stores Management System. This system is used in F/A-18 aircraft blocks 5 through 19. The system includes the Aircraft Instrumentation Subsystem Internal (AISI) 152, gun decoder 154, stores management processor 156, and station 1/9 decoder 158. The AISI 152 is coupled to avionics busses 160–162 and an EW bus 164. The gun decoder 154, stores management processor 156, and station 1/9 decoder 158 are interconnected by a primary armament bus 182 and a secondary armament bus 180.

2. Applicable Documents

This section contains the specifications, standards, and other documents referenced in the body of this ICD.

2.1 General

Although the present disclosure provides a complete and self-sufficient description of the invention, an expansive volume of supplementary material is discussed in various documents listed below. Among these documents are a number of indexed, publicly available publications, such as those defining various military standards ("MIL-STDs").

2.1.1 Military

| | |
|---|---|
| MIL-O-9858 | Quality Program Requirements |
| MIL-HD-BK-217E | Reliability Prediction of Electronic Equipment |

Note: The NAVAIR F-18 Aircraft Wiring Publication used as references are listed in Table 9.

-continued 2.1.2 Standards

| | |
|---|---|
| MIL-STD-454 | Standard General Requirements for Electronic Equipment |
| MIL-STD-461B | Requirements for the Control of Electromagnetic Interference Emissions and Susceptibility |
| MIL-STD-810D | Environmental Test Methods and Engineering Guidelines |
| MIL-STD-883C | Test Methods and Procedures for Microelectronics |
| MIL-STD-1553 | Aircraft Internal Time division Command/Response Multiplex Data Bus |

2.1.3 Other Documents

| | |
|---|---|
| ICD9704-0200 | Interface Control Documents, April 2, 1997 |
| ATP 9704-0470 | Acceptance Test Procedure, May 12, 1998 |
| TP 9704-0300 | Environmental Qualification Demonstration, February 13, 1998 |
| TA 9704-0460 | Test Plan |

2.2 Abbreviations

| | |
|---|---|
| ACMI | Air Combat Maneuvering Instrumentation |
| ACT-R | Air Combat Training-Rangeless |
| ACTID | Air Combat Training Interface Device |
| AIS | Airborne Instrumentation Subsystem |
| AISI | Airborne Instrumentation Subsystem Internal |
| AISI(K) | Airborne Instrumentation Subsystem Internal (Encrypted) |
| BC | Bus Controller |
| BIT | Built In Test |
| BM | Bus Monitor |
| CDS | Cubic Defense Systems |
| COTS | Commercial Off The Shelf |
| DMA | Direct Memory Access |
| EPROM | Erasable Programmable Read Only Memory |
| FEPROM | Flash Erasable Programmable Read Only Memory |
| ICD | Interface Control Document |
| IP | Interface Processor |
| KITS | Kadena Interim Training System |
| LED | Light Emitting Diode |
| MUX | Multiplex |
| PC | Personal Computer |
| PTP | Program Test Plan |
| RAM | Random Access Memory |
| RF | Radio Frequency |
| ROM | Read Only Memory |
| RT | Remote Terminal |
| SMP | Stores Management System |
| STA | Station |
| T/R | Transmit/Receive |
| TP | Test Procedure |
| Vac | Volts, Alternating Current |
| Vdc | Volts, Direct Current |

3. Interface Definition

Figure 13:
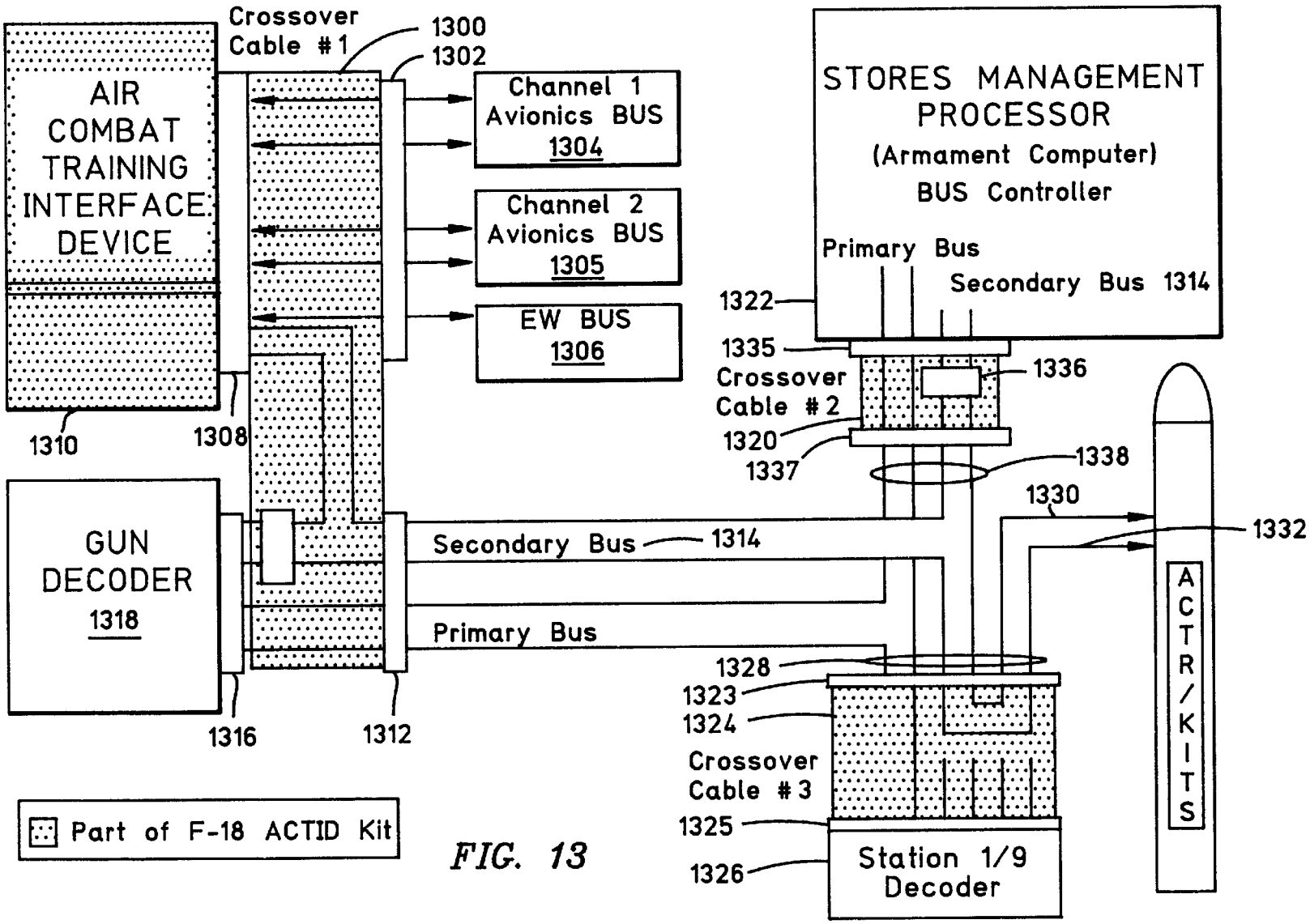
FIG. 13 is a block diagram of an F/A-18 air combat training interface kit according to the invention.

The Air Combat Training Interface Device 1310 interfaces with the F-18 avionics data busses in accordance with McDonnell-Douglas Corporation report MDC-A-3818 and ICD-F-18-008. The messages from the data busses are combined into a new message format resulting in a single serial data bus which is routed to wing tip stations 1 and 9 via the F-18's Secondary Armament Mux bus 1314 and Crossover Cables as detailed below. The electrical and physical interface is in accordance with provisions detailed in ICD-F-18-009. FIG. 13 is a block diagram of the interface configuration.

3.1 Air Combat Training Interface Device Electrical Interface

The Air Combat Training Interface Device receives aircraft electrical power and data via the same aircraft connectors which provide power and data to existing CDS designed AISIs and AISI(K)s. Data messages are monitored from Avionics Mux Bus 1 (1304), Avionics Mux Bus 2 (1305), and the Electronic Warfare Mux Bus 1306 in the same manner as those monitored by the AISI and AISI(K). All received messages are processed by the Air Combat Training Interface Device 1310 and transferred to wing tip weapon station 1 and 9 via the Crossover Cable Kit and existing aircraft wiring.

3.2 Crossover Interface Cables

There are three crossover cable interfaces that make up the Crossover Cable Kit; the Air Combat Training Interface Device Crossover Cable 1300, the Stores Management Processor Crossover Cable 1320 and the Decoder Crossover Cable 1324.

3.2.1 Air Combat Training Interface Device Crossover Cable

The Air Combat Training Interface Device Crossover Cable 1300 has four connector interfaces 1308, 1302, 1316, 1312 as shown in FIG. 13 (Crossover Cable #1). One interface connector 1302 interfaces to the aircraft's Avionics 1304–1305 and Electronic Warfare Mux 1306 data busses. A second interface connector 1308 routes this aircraft digital data as an input to the Air Combat Training Interface Device 1310. A third interface connector 1312 interfaces the aircraft input and output signals to the Gun Decoder 1314 and routes the output data from the Air Combat Training Interface Device 1310 to the aircraft's Secondary Armament Bus 1314. The fourth interface connector 1316 routes all aircraft signals to the Gun Decoder 1314, except the Secondary Armament Bus 1318 which is isolated from the Gun Decoder 1318 by not connecting the appropriate pins in the crossover cable 1300.

3.2.2 Stores Management Processor Crossover Cable

The Stores Management Processor (SMP) Crossover Cable 1320 is installed between the Stores Management Processor 1322 and existing aircraft wiring 1338 as shown in FIG. 13 (Crossover Cable #2). The purpose of this crossover cable is to disconnect the Stores Management Processor 1322 as the Bus Controller on the Secondary Armament Bus 1314 by removing connections 1336 associated with pins in this crossover cable.

3.2.3 Decoder Crossover Cable

The Decoder Crossover Cable 1324 can be installed at weapon station 1 or 9 between the KY-851 Decoder 1326 and existing aircraft wiring 1328 as shown in FIG. 13 (Crossover Cable #3). This crossover cable completes the isolation process of the Secondary Armament Bus 1314 by internally connecting the Secondary Armament Bus 1314 input wires to the existing aircraft Right/Left Reference 1330 and Acquisition Lambda 1332 wires. In effect, the data present on the data bus bypasses the decoder and is sent to the weapon station.

3.3 Pod Interface

Air Combat Training pods 1334 are mounted on F-18 wing tip weapon station 1 and 9 LAU-7 launchers. Present pod configurations do not support this or any F-18 Avionics/Electronic Warfare Mux Bus interface. Both ACT-R and KITS pods can be upgraded to support the Air Combat Training Interface Device and Crossover Cable Kit by means of a software load and replacement of the existing Umbilical Cable with one that routes Right/Left Reference and Acquisition Lambda signals from a LAU-7 launcher to the pod's MIL-STD-1553 Mux Bus interface.

4. Mechanical Interface 4.1 ACTID Mechanical Interface Installation

The Air Combat Training Interface Device is installed using the same mounting tray used for Airborne Instrumentation Subsystem Internal (AISI) and AISI(K), encrypted, presently flown on F-18 aircraft. The prototype ACTID has been built into an existing Aircraft Instrumentation Subsystem Internal (AISI) chassis and is installed in place of the AISI in the Gun Bay area of the F-18 in the nose section of the aircraft. This design approach allows the Air Combat Training Interface Device easy access to existing F-18 mounting hardware as well as power and data bus input connections available on block 5 and subsequent aircraft.

4.2 Crossover Cable Mechanical Interface

The Crossover Cable Mechanical Interface consist of the connectors and associated wiring which make up the crossover cables.

The part numbers for the eight connectors; four (4) for the ACTID Crossover Cable, two (2) for the SMP Crossover Cable, and two (2) for the Decoder Crossover Cable are listed in Table 7. Tables 3 thru 6 list the type of wire installed in the aircraft associated with each pin on each connector in the aircraft which mates with the Crossover Cables. A description of wire types used in the Crossover Cables are listed in Table 10.

5. Electrical Interface 5.1 ACTID Electrical Interface

Figure 14:
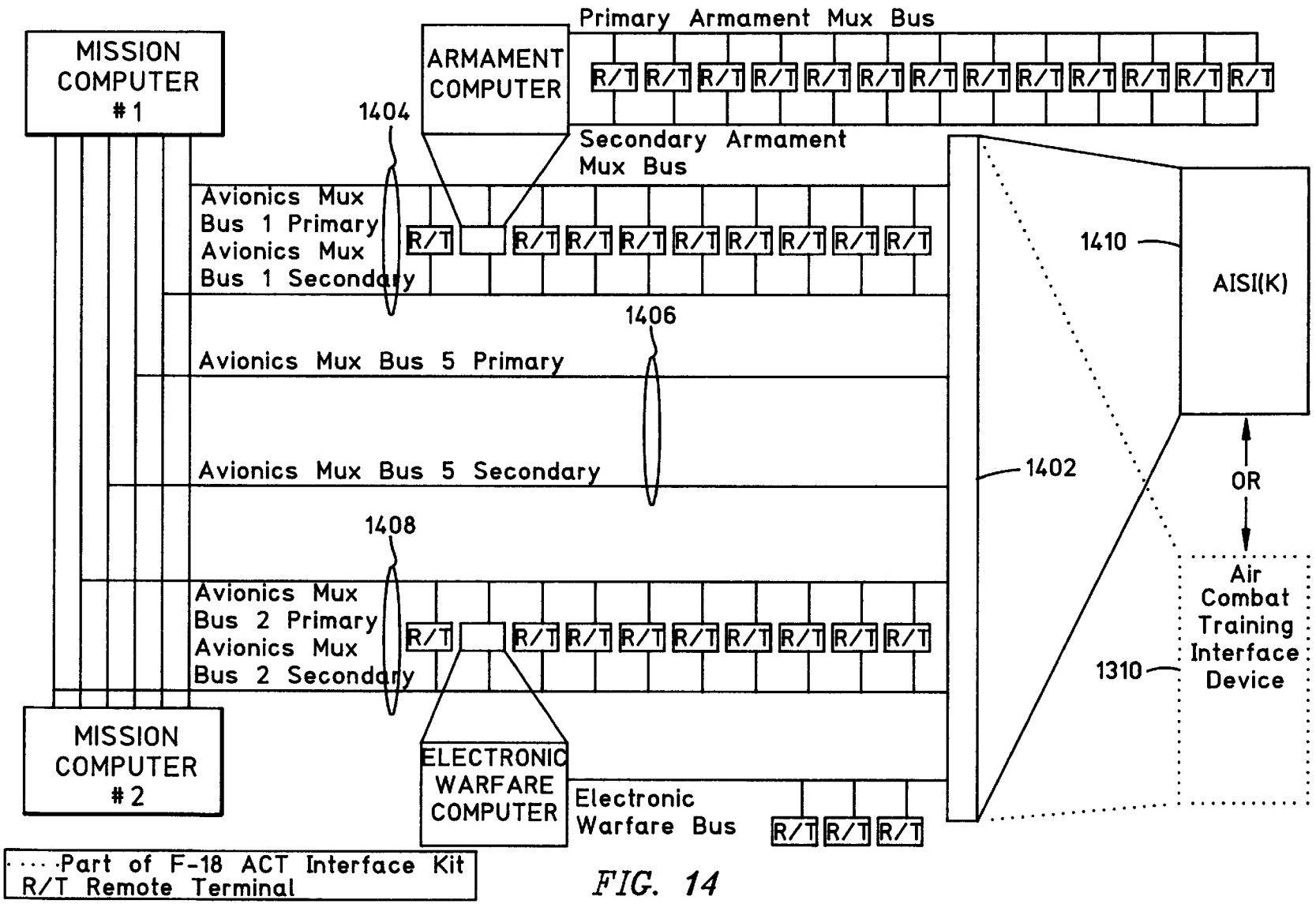
FIG. 14 is a block diagram of an F-18 data bus to ACDID interface.

The ACTID 1400 receives aircraft electrical power through the same connector which provided power to the AISI (Table 2). The ACTID interface 1402 with the aircraft 1553 data busses 1404–1408 (FIG. 14) is accomplished via the same connector 1302 which provided aircraft digital data to the AISI 1410. (See Table 2 for pin assignment.)

Figure 16:
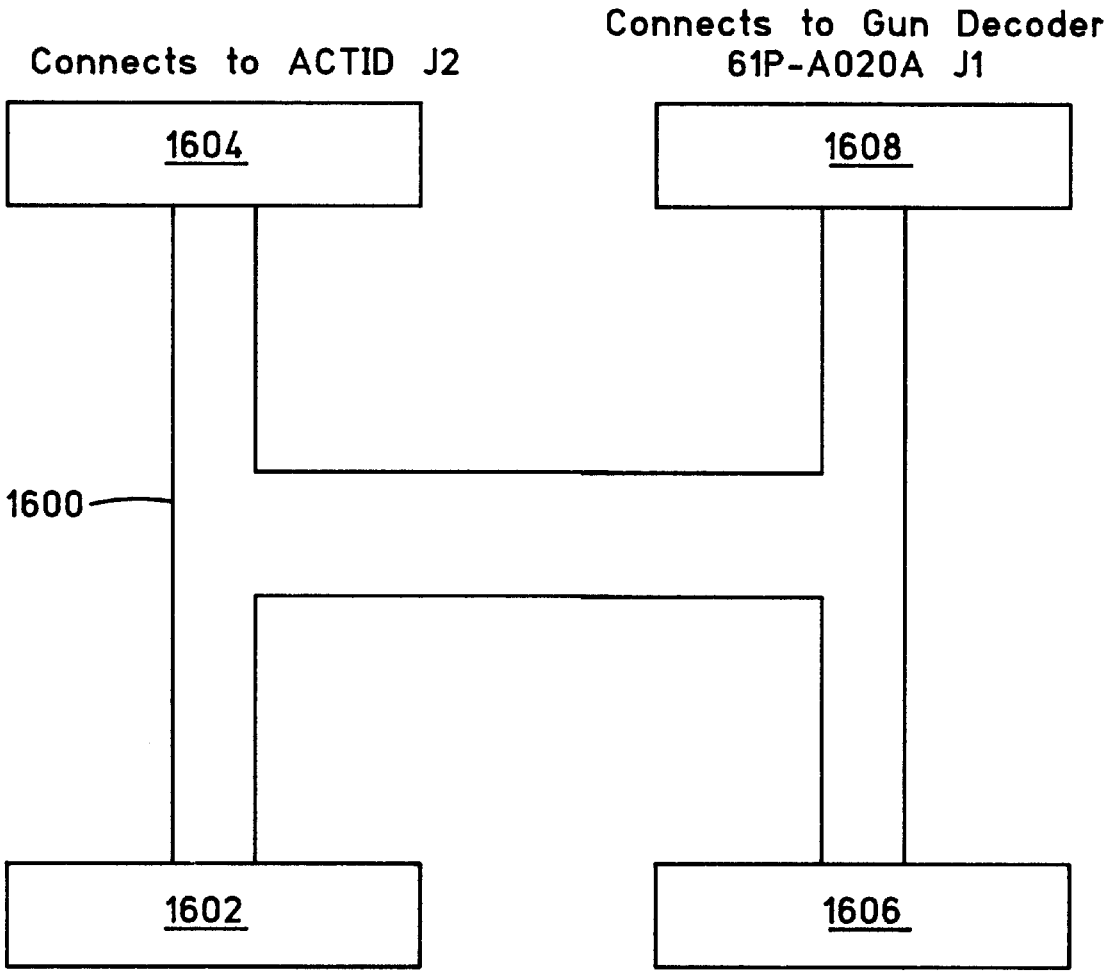
FIG. 16 is a block diagram of an ACTID crossover cable according to the invention.

5.2 Crossover Interface Connections 5.2.1 ACTID Crossover Cable Interface Connections The ACTID Crossover Cable 1600 has four connectors as shown in FIG. 16. The first connector 1602 mates with the existing aircraft connector (61P-A246B) which provides the interface to the aircraft data buses. A second connector 1604 (P2) connects to the ACTID and provides ACTID input and output digital data. A third connector 1606 mates with existing aircraft connector (61P-A020A-J1) which ties the ACTID output to the aircraft Secondary Armament Bus. The fourth connector 1608 connects to the Gun Decoder (61P-A020A-P1), passing through all signals normally connected to the Gun Decoder except the Secondary Armament Bus.

Figure 15:
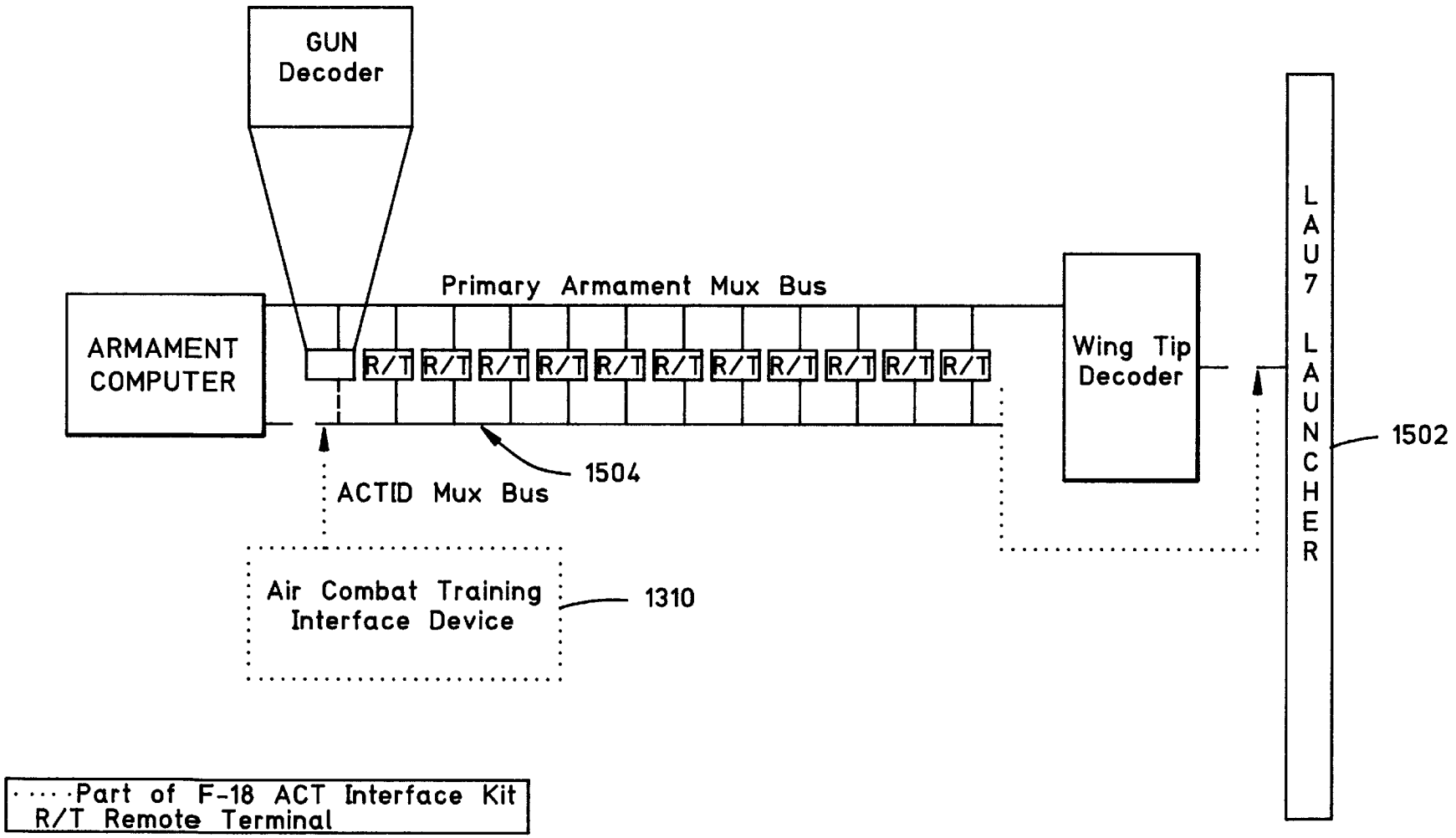
FIG. 15 is a block diagram of an ACTID MUX bus according to the invention.
Figure 20:
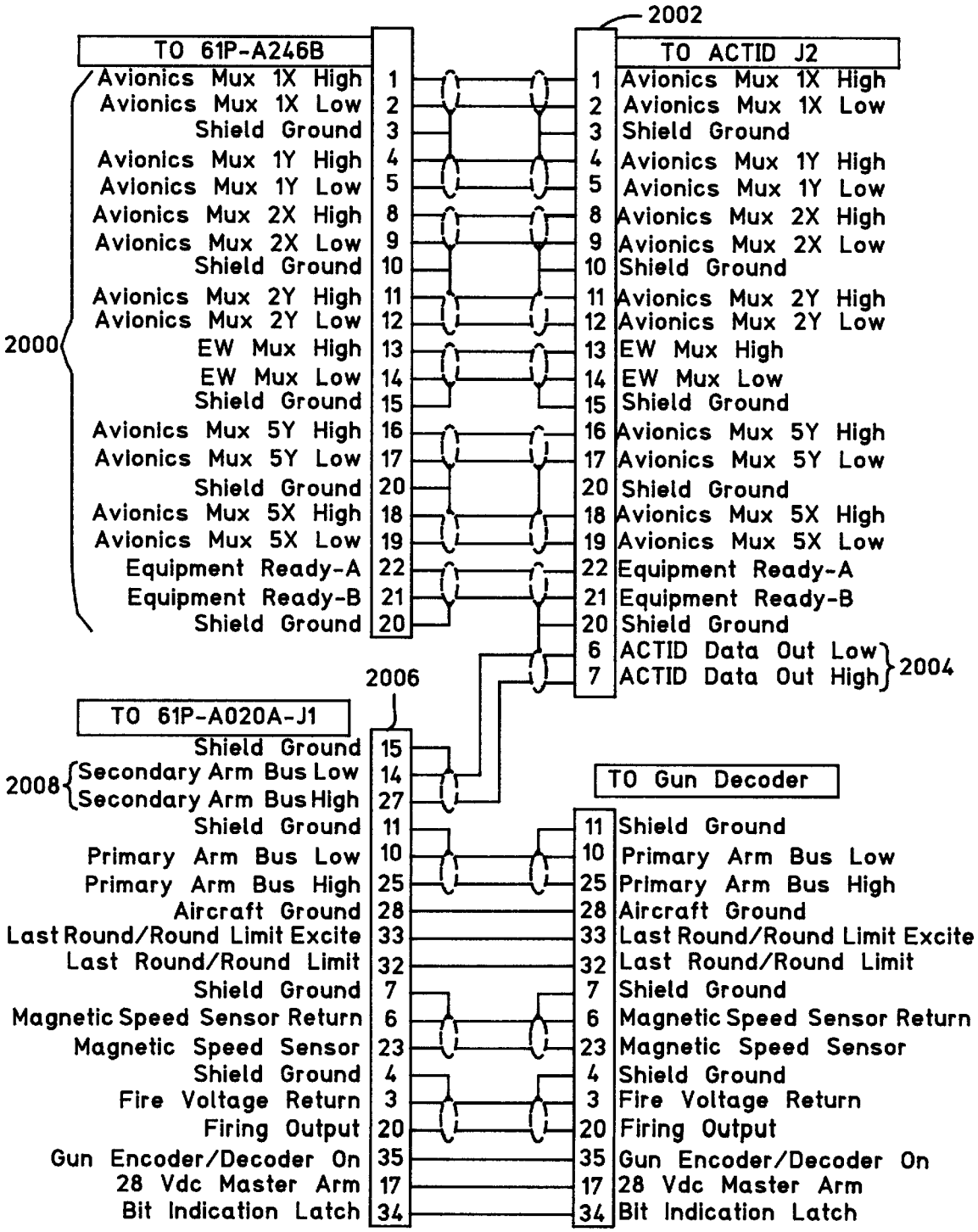
FIG. 20 is a wiring diagram of an ACTID crossover cable according to the invention.

The ACTID crossover cable wiring diagram (FIG. 20) shows pin-to-pin wiring with the name of the signals carried on each wire. The existing aircraft wiring 2000 to connector 61P-A246B provides access to; Avionics Mux Bus 1 (X & Y), Avionics Mux Bus 2 (X & Y), the Electronic Warfare Mux Bus, and Avionics Mux Bus 5 (X & Y) (Lot 12 Block 29 & Sub)). These signals are connected to the Air Combat Training Interface Device through connector P2 2002 of the ACTID Crossover Cable. The ACTID output digital data 2004 flows through P2 2002 of the ACTID Crossover Cable to connector 61P-A020A-P1 2006 which connects to existing aircraft wiring (Secondary Armament Bus 2008) at connector 61P-A020A-J1. The signals normally provided to the Gun Decoder through aircraft connector 61P-A020A-J1, now flow through the ACTID Crossover Cable. That is all signals except the Secondary Armament Bus. Through these ACTID Crossover Cable connections 2004, 2008 the Air Combat Training Interface Device 1310 becomes the Bus Controller on the ACTID Mux Bus 1504 (Secondary Armament Bus 1412 which is no longer connected to the Gun Decoder). FIG. 15 shows the data path from the ACTID 1500 to the wing tip station launcher 1502. Table 7 (61P-A246B Pin Assignment) and Table 6 (61P-A020A Pin Assignment) list the aircraft wire number, wire type and signal name associated with each pin number of the Air Combat Training Interface Device Crossover Cable connectors.

5.2.2 Stores Management Processor Crossover Cable Interface Connections

Figure 17:
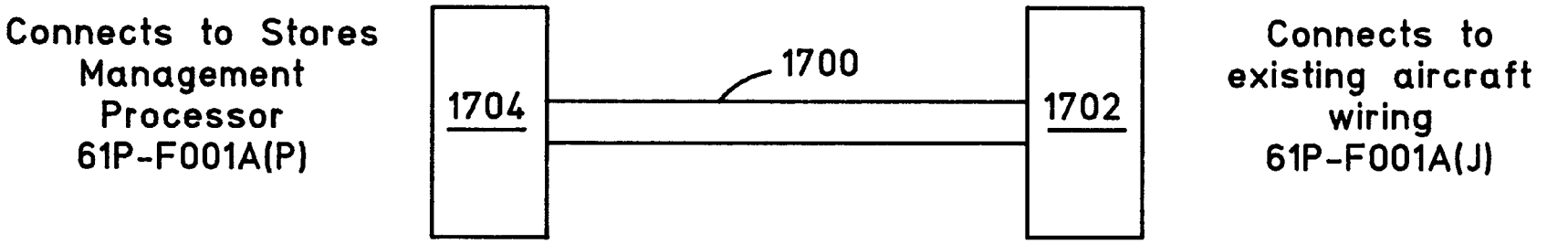
FIG. 17 is a block diagram of a stores management processor crossover cable according to the invention.

The Stores Management Processor (SMP) Crossover Cable 1700 (FIG. 17) is installed between aircraft connector 61P-F001A-P1 1702 and SMP connector 61P-F001A-J1 1704. This crossover cable passes through all signals except the Secondary Armament Bus.

Figure 21:
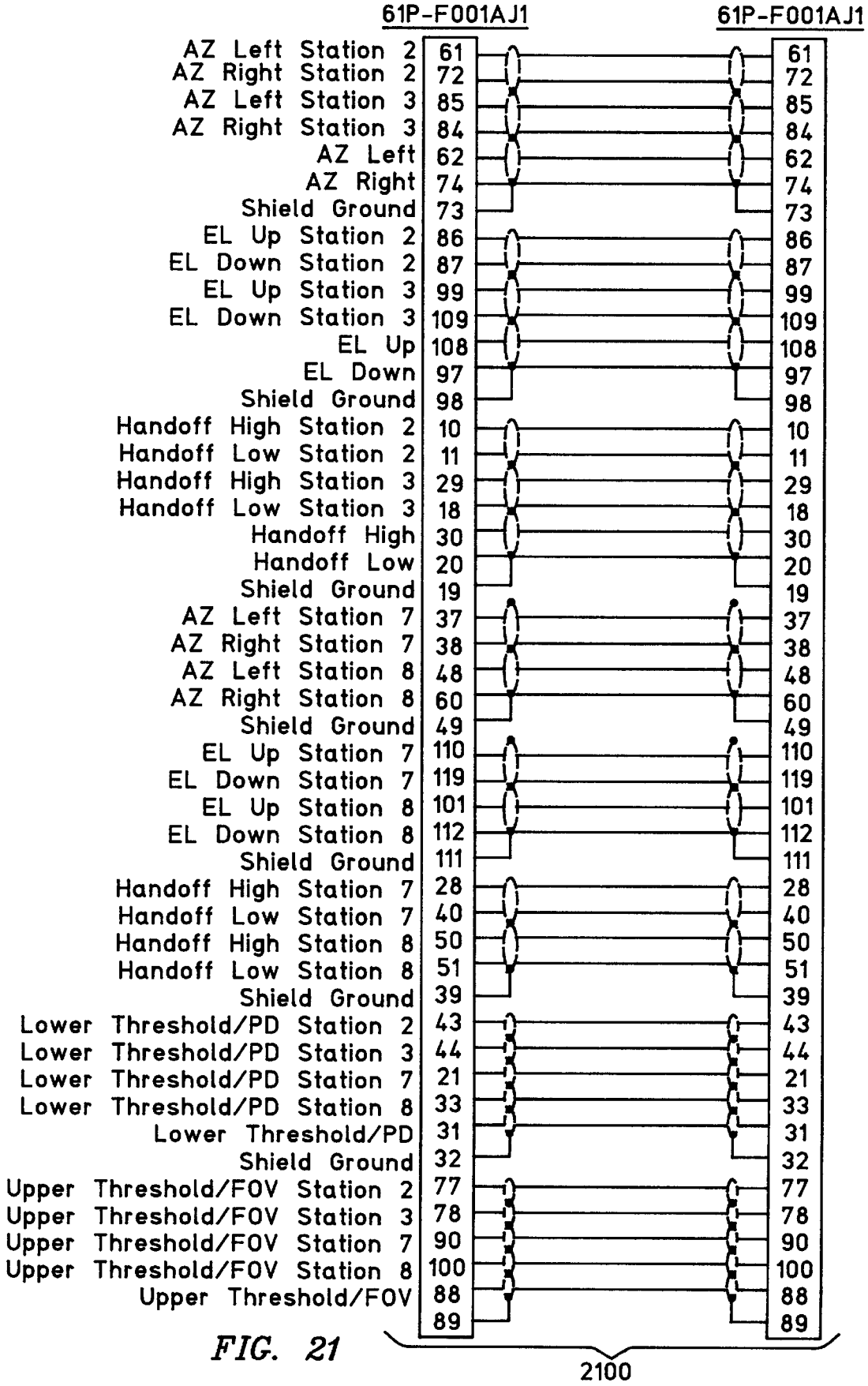
FIG. 21 is a wiring diagram of an SMP crossover cable according to the invention.
Figure 21A:
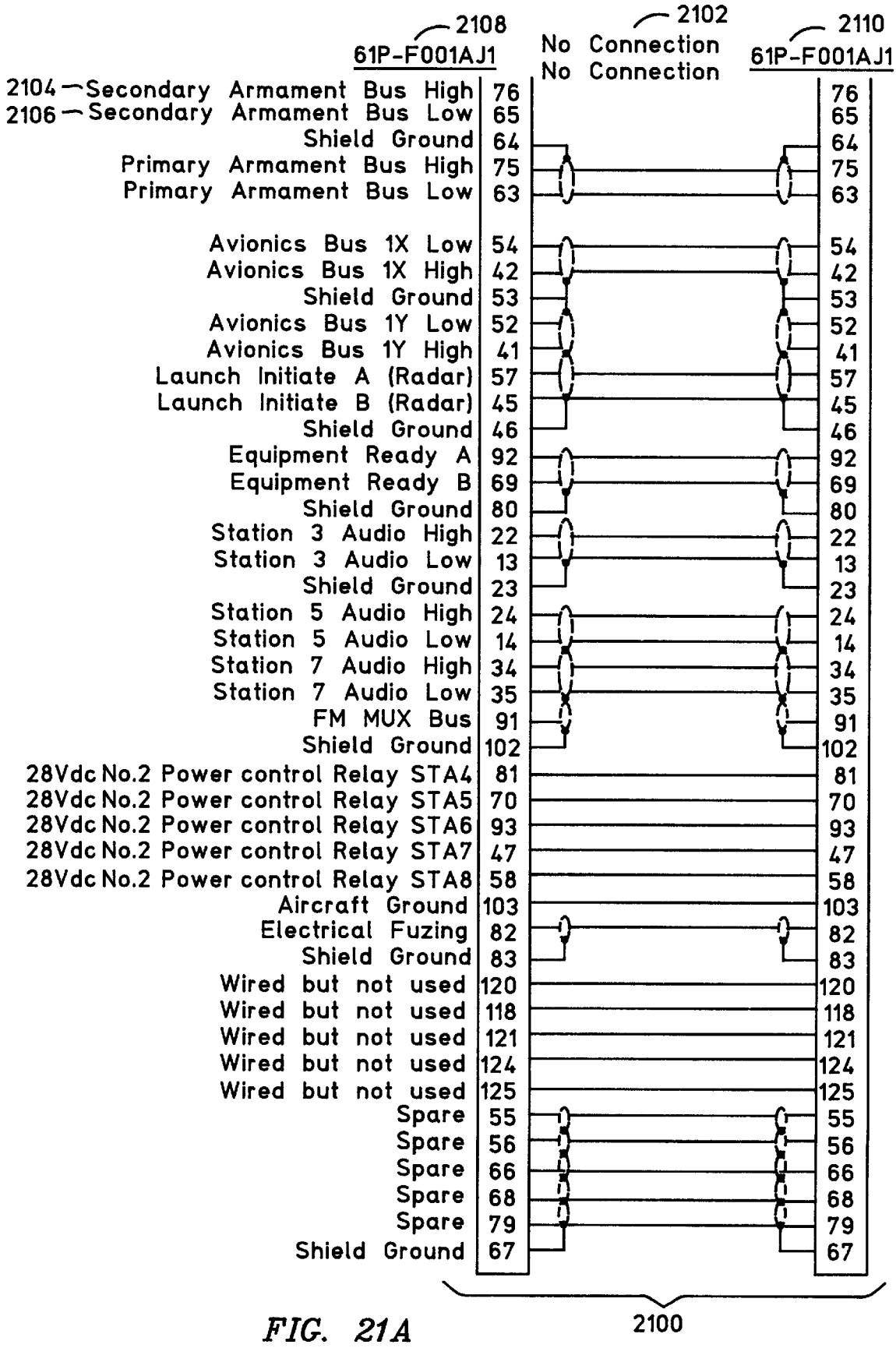
FIG. 21*a* is a wiring diagram of an SMP crossover cable according to the invention.

The SMP Crossover Cable wiring diagram 2100 (FIGS. 21–21*a*) shows pin-to-pin wiring with the name of the signal carried on each wire. The existing aircraft wiring to connector 61P-F001A-P1 provides for input and output signals to the Stores Management Processor (Armament Computer). These wires, with the exception of the Secondary Armament Bus 2102, are connected to the SMP through the SMP Crossover Cable. Disconnecting 1336 the Secondary Armament Bus from the SMP removes the SMP as Bus Controller on the Secondary Armament Bus. Table 4 (61P-F001A Pin Assignment) list the aircraft wire number, wire type and signal name associated with each pin number of the connection to Stores Management Processor Crossover Cable.

5.2.3 Decoder Crossover Cable Interface Connections

Figure 18:
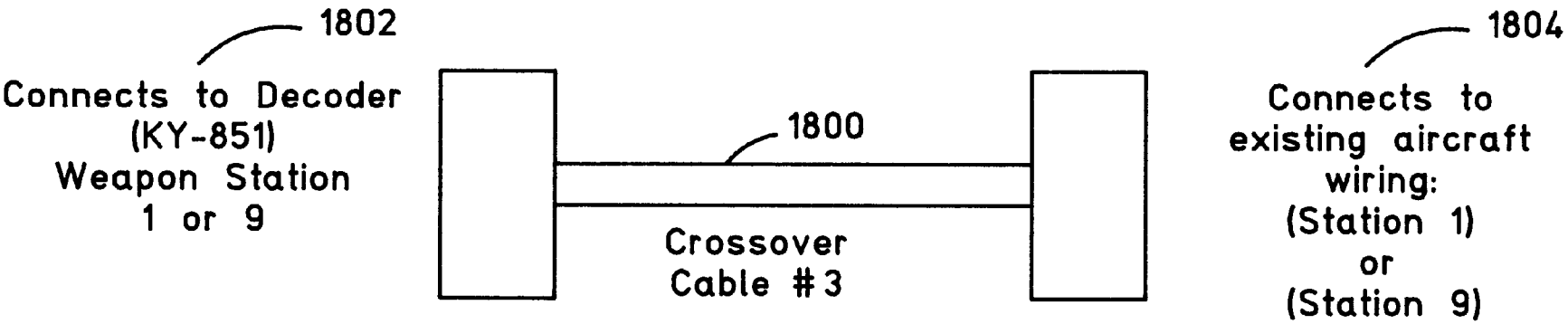
FIG. 18 is a block diagram of a decoder crossover cable according to the invention.
Figure 22:
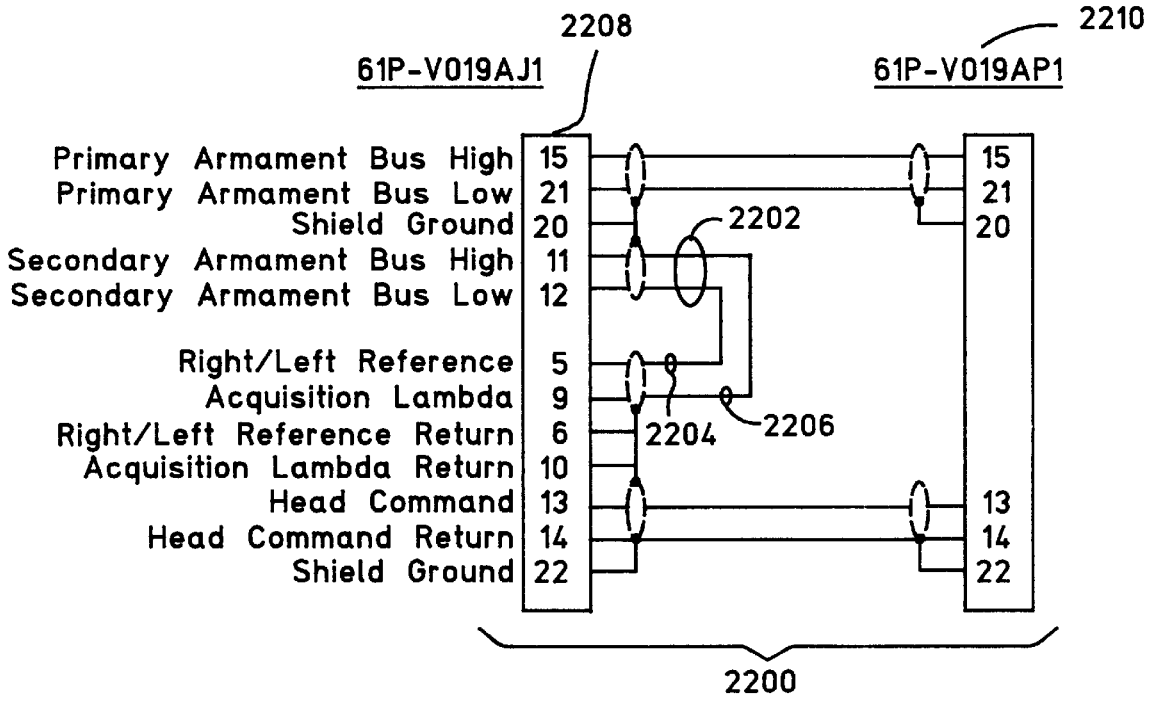
FIG. 22 is a wiring diagram of a decoder crossover cable (station 9) according to the invention.
Figure 22A:
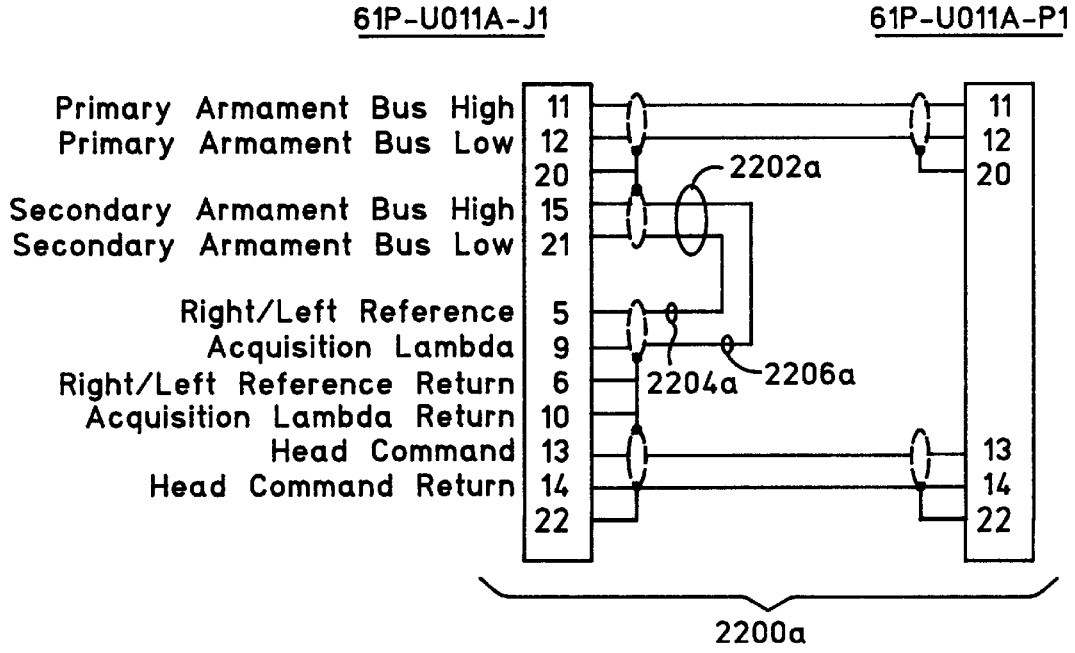
FIG. 22*a* is a wiring diagram of a decoder crossover cable (station 1) according to the invention.

The Decoder Crossover Cable 1800 (FIG. 18) is installed between the Decoder 1802 and aircraft connector 1804 61P-U011A-P1 (Station 1) or 61P-V019A-P1 (Station 9). This crossover cable passes through all signals except the Secondary Armament Bus, Right/Left Reference, and Acquisition Lambda. Since the Secondary Armament Bus wiring goes to Decoder pins 11 and 12 at wing tip station 9 and to Decoder pins 15 and 21 at wing tip station 1, unique Decoder Crossover Cables are required at each wing tip station. (See FIG. 22/22*a*)

The Decoder Crossover Cable wiring diagram 2200/2200*a* (FIG. 22/22*a*) shows pin-to-pin wiring with the name of the signal carried on each wire. These wires, with the exception of the Secondary Armament Bus 2202/2202*a*, the Right/Left Reference 2204/2204*a* and Acquisition Lambda 2206/2206*a* are connected to the Decoder through the Decoder Crossover Cable. Internal to the crossover cable the Secondary Armament Bus 2202/2202*a* is connected to the Right/Left Reference 2204/2204*a* and Acquisition Lambda 2206/2206*a* wires. Table 5 (61P-U011A/61P-V019A Pin Assignment) list the aircraft wire number, wire type and signal name associated with each pin number of the connectors of the Decoder Crossover Cable.

6. Air Combat Training Interface Device Description 6.1 ACTID Definition

For specified aircraft, the ACTID 1310 is the Air Combat Training Interface Device which provides aircraft weapons data to an Air Combat Training pod 1334 for Air Combat Training. Air Combat Training allows pilots to train in air warfare without live firing of weapons. To support Air Combat Training, the ACTID 1310 extracts data from the host aircraft data busses 1304–1306 and transfers the data to the Air Combat Training pod 1334 mounted on an aircraft wing tip weapon station using existing aircraft wiring.

6.2 Mission

The ACTID operates as an interface device in support of Air Combat Training. The ACTID is mounted internal to specified aircraft and is capable of monitoring aircraft flight data (e.g., attitude, velocity, acceleration, roll/pitch/yaw rates, and air data parameters), weapons data, and other data as specified, and transmits these data to the Air Combat Training pod mounted on the aircraft wing tip weapon station. The ACTID is also capable of receiving specified data and provide them as input to aircraft subsystems via one or more multiplex data busses.

6.3 ACTID Diagram

Figure 19:
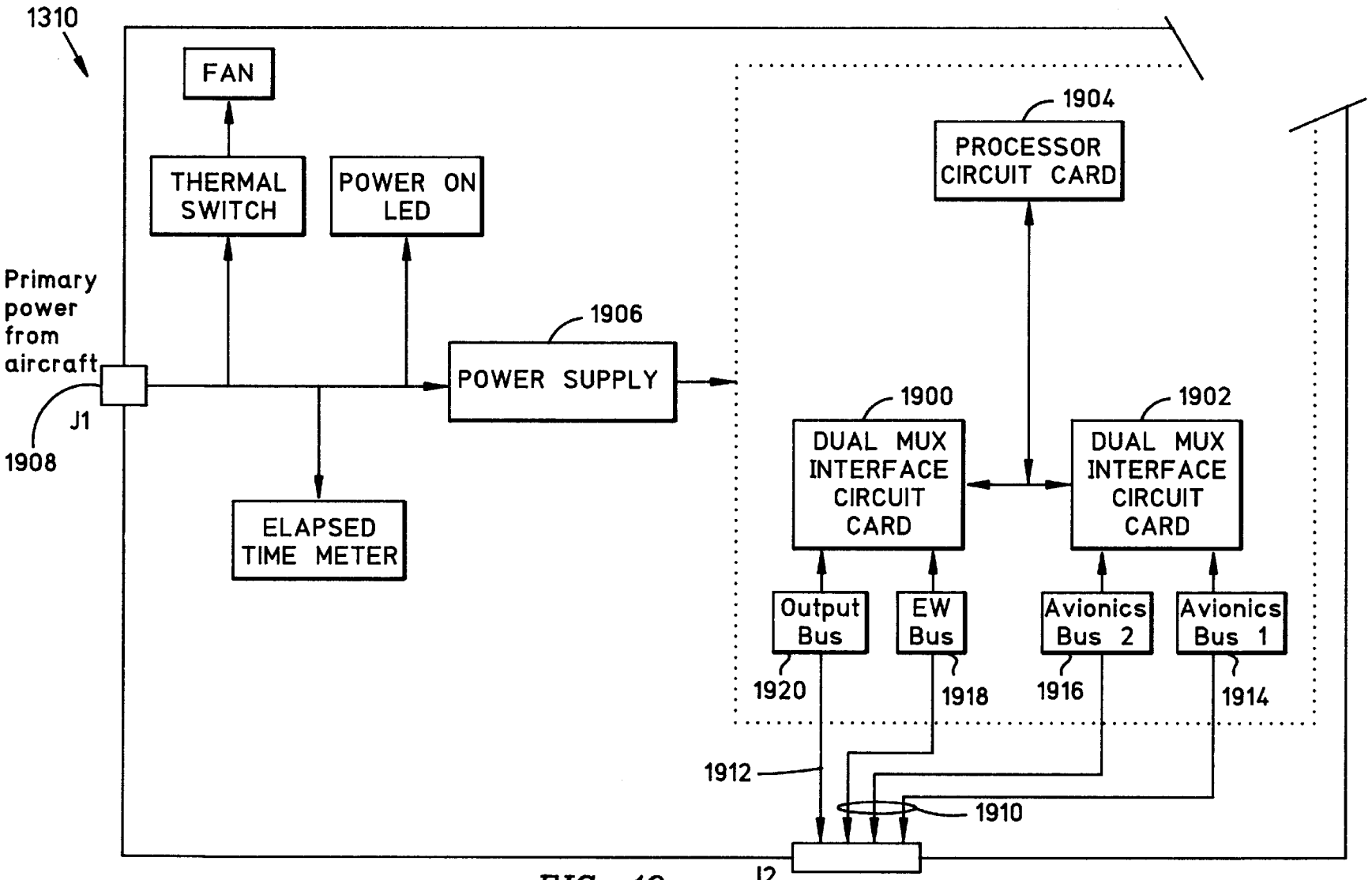
FIG. 19 is a block diagram of an air combat training interface device according to the invention.

The ACTID consists of two dual 1553 data bus assemblies 1900/1902, one processor assembly 1904 and a Power Supply Assembly 1906 (PSA) as shown in FIG. 19. The ACTID has three major interfaces:

1. Electrical power input from the aircraft 1908
2. Digital Data input from the aircraft 1910
3. Digital Data output to the Air Combat Training pod 1912

6.3.1 Electrical Power Input from the Aircraft

The aircraft provides 28 Vdc and single phase, 115 Vac, 400 Hz primary power to the ACTID. These inputs are used in the ACTID to derive the voltages to power the cooling fan, power Indicator light, Elapsed Time Meter (ETM) and logic voltages necessary for 1553 bus interface and data processing.

6.3.1.1 Input Power

The Power Supply maintains full capability in all ACTID functions when using aircraft-generated 115-Vac, 400 Hz, single-phase power supplied in accordance with the limits specified in MIL-STD-704. The Power Supply draws no more than 3.0 A of current at a power factor no less than 0.9.

6.3.1.2 Output Voltages

The Power Supply provides dc output voltages necessary to support the other ACTID functions. Outputs have return lines tied to chassis or other common ground and exhibit a minimum of 70 db mutual isolation from 7.5 MHz to 1 GHz. Each output also exhibits at least 35 db isolation from the input power lines from 7.5 MHz to 1 GHz. The maximum output current levels for each voltage includes a 30 percent margin to accommodate future growth.

6.3.2 Digital Data input from the aircraft

The ACTID 1310 provides the capability to access data simultaneously from up to three MIL-STD-1553 multiplex data busses, and to process the information contained therein. These MIL-STD-1553 interfaces are configured to accommodate; (1) the MIL-STD-1553A interface used in the AN/ALR-67, (2) the requirements of MDC A3818 for operation in the F-18 and (3) MIL-STD-1553B. The hardware interface is shown in FIG. 19. The capability to access data from each bus provides for acquisition of dedicated messages intended for the ACTID (Remote Terminal [RT] operation) as well as simultaneous acquisition of data contained in bus traffic not intended for the ACTID (i.e., Bus Monitor [BM] operation). Data collection includes but is not limited to weapons system status data, pressure measurements from the air data sensor, radar altitude measurements, Electronic Warfare (EW) threat detection, aircraft attitude data (Euler angles), velocity data, acceleration data, angular rate data, and navigation data. The ACTID also monitors incoming bus traffic for specific commands addressed to the ACTID by the aircraft (e.g., to perform a WARM BIT operation and report the results). The ACTID receives data from the aircraft computers via two fully redundant multiplex busses (MUX-1 1914 and MUX-2 1916) as specified in MDC A3818. It also monitors the traffic on the NRL-STD-1553A EW bus 1918 as specified in ICD207-6C. Additionally, the ACTID provides the aircraft with an "equipment ready" signal.

6.4 Digital Data output to the Air Combat Training pod

The ACTID's primary function is that of multiplexer which is a data flow function. The ACTID performs no operations on the input data and transparently moves data from the input MUX Interface to the transmitting MUX Interface which sends the data to the ACT-R pod.

7. Software 7.1 Identification

The ACTID software is partitioned into five functions which all execute on an Intel 80C186 processor and interface with four DDC BU-61580 MUX Interface devices. These functions include: Initialization, Data Processing, Built-in-Test, Diagnostic, and Booter/Loader.

7.2 Interface 7.2.1 Initialization

Inputs

1. Interface Selector (i.e., MUX A, B, C, or D Interface).
2. Type of NHL-STD-1553 Operation (i.e., Bus Controller, Remote Terminal, Bus Monitor, or Remote Terminal/Bus Monitor combination).
3. Address for Remote Terminals.
4. Parameters of valid messages to be processed.

Outputs

1. Receive or Transmit buffer area defined in shared RAM for each message.
2. Initialized buffer pointers.
3. Look-Up Table entries for valid messages.

7.2.2 Data Processing

Inputs

1. Descriptor Stacks which relay message transfer status from the DDC devices to the host processor.
2. Message buffers that contain received data.
3. Translation Table containing the translation parameters used to translate the Command Word between Aircraft and ACT-R messages.

Outputs

1. Message buffers that contain data to be transmitted.
2. Updated buffer pointers.

3a. Look-Up Table entries that specify the location of transmit data buffers.

3b. Descriptor Stack entries that specify the message to be transferred.

7.2.3 Built-in-Test

1. Aircraft Terminal Test Word.

Outputs

1. Results of each selective test.
2. Aircraft Terminal Reply Test Word.
3. Post BIT state of DDC interface devices.
4. Post BIT state of Dual-Port RAM and host processor memory.

7.2.4 Diagnostic

Inputs

1. Commands from diagnostic terminal.
2. Data from diagnostic terminal used to modify either MUX Interface device's registers or memory (MUX Interface device or host processor).

Outputs

1. Data from either MUX Interface device registers or memory.

7.3 Processes

FIG. 1 and the following paragraphs describe the software processes.

7.3.1 Initialization

Hardware Initialization involves loading the configuration registers of the programmable peripheral devices controlled by the host processor. The two major types of peripheral device are those integrated in the Intel 80C186 processor itself and the DDC devices that service each MUX Interface. The processor initializes these peripherals by copying data stored as constants in ROM to the peripheral's configuration registers.

The ACTID is initialized in two stages. Following reset 100, the processor's integrated peripherals are initialized 102. These include the Watchdog Timer, the Peripheral Select signals, the Interrupt Controller, and the Serial Controller. These peripherals are initialized before beginning either the Normal 104 or Built-in-Test 106 operational processes.

Following the Built-in-Test 106 process, all of the MUX Interface devices are initialized 108 and configured for the protocol of their respective bus. In addition, all of the data structures required for processing data between the MUX Interfaces and the processor are initialized 108. The data structure initialization begins with the initialization of all variables to default values as if there were no messages to be processed. Then, the data structures are built up for each message to be processed.

The information in the initialized data structure 108 includes pointers to locate stacks and data buffers shared by the processor and MUX Interface device. Additional information controls how the MUX Interface device is to respond to the various messages on the bus based on the message's RT address, subaddress, and direction.

7.3.2 Normal Operation

In normal operation, the ACTID transfers data between any (f the three aircraft MUX Interfaces and the ACT-R MUX Interface. The ACTID polls all MUX Interfaces for either newly received data (RT and/or BM), or availability of the Interface to send/get data (BC).

Data from a Remote Terminal or Bus Monitor is validated and then copied from its receive buffer to its new transmit buffer. Each buffer location corresponds to a unique Remote Terminal Address, Subaddress, and direction (transmit or receive) and data is transferred from one buffer to another according to information specified in the Translation Table. Messages collected from each aircraft MUX Interface are reformatted to include a time tag and to uniquely identify each aircraft message for the ACT-R pod. In addition, some aircraft messages are split into two separate messages. ACT-R messages for the aircraft are reformatted to replace ACT-R message IDs with aircraft RT addresses (and subaddresses) and to recombine split ACT-R messages into single aircraft messages.

The time tag placed in ACT-R bound messages has a 2 microsecond resolution and is the difference between the ACT-R MUX Interface timer and the difference between the aircraft MUX Interface timer and the Time Tag in the Descriptor Stack for the message being processed. The ACTID synchronizes the ACT-R pod to the ACTID's timer in the ACTID's ACT-R MUX Interface device by using the Synchronize with Data Word Mode Command (Mode Code 17).

The ACTID assigns to each aircraft message type it processes a unique message identifier used in ACT-R messages. For message ID numbers 1 through 29, the ID is placed in the 5-bit Subaddress field of the Command Word of the ACT-R message. For ID numbers 30 through 65535, the Subaddress field in the Command Word is assigned the value of 30 and an expanded Subaddress word is inserted into the first word of the Data field of the message.

Since some aircraft messages may not have enough room for the Expanded Subaddress and/or Time Tag words, some aircraft messages are transferred as two ACT-R messages. The first ACT-R message contains the first 30 or 31 words of the aircraft message, Expanded Subaddress (for IDs >29), and the Time Tag (ACT-R bound only). The second ACT-R message contains the last one or two words of the aircraft message and an Expanded Subaddress word (always). The differentiation between the two messages is determined by the Word Count field in the message's Command Word.

The ACTID queues data from the aircraft to the ACT-R pod at the ACT-R MUX Interface and positions the messages in the queue according to the priority specified in the Translation Table.

When ACT-R data is available for the aircraft, the ACTID gets the data from the ACT-R pod and puts it into a transmit buffer at the MUX Interface specified by the Translation Table. The ACTID determines when the ACT-R pod has data available by polling the pod.

7.3.3 Built-in-Test

There are two Built-in-Test 106 (BIT) processes. One is a Cold BIT 110 and the other is a Warm BIT 112. Cold BIT 110 is executed only upon power-up or upon command from the diagnostic process. The Warm BIT 112 is executed only upon command from a MUX bus by the aircraft.

The Cold (Power-Up) Built-in-Test (BIT) 110 tests processor ROM and RAM, and each MUX Interface device. This test completely resets all processor RAM and all MUX Interface RAM and Registers.

The ROM test calculates checksums for each Flash EPROM sector and compares the calculated sum to the sum stored in ROM. The calculated sum is simply the modulo 16 sum of every 16-bit word in a sector. Each calculated checksum for each sector will be equal to the checksum stored in ROM with the exception for sector 5. The calculated checksum of sector 5 will be modulo 16 twice the checksum stored in ROM. The checksums stored in ROM are stored in sector 5 where they are placed whenever a new program is loaded into ROM.

The RAM tests write both fixed patterns and address related patterns to RAM. After each pattern is completely written, the tests verify that the same patterns can be read back. The fixed patterns used are AAAAh, 5555h, FFFFh, and 0000h. The processor address related patterns are [00000h]=0000h, [00002h]=0001h, . . . ,[1FFFEh]=FFFFh and [00001h]=FFFFh, [00003h]=FFFEh, . . . , [1FFFDh]=0001h. The MUX Interface RAM address related patterns are the same as the processor's but with different address ranges.

The MUX Interface logic test programs each MUX Interface device as an off-line Bus Controller and sends a message from the device. Upon completion of the message, the processor verifies that none of the device's on-line error checking flags have been set and that the last word in the message sent has been correctly wrapped around and stored in RAM at the expected location.

Upon any processor test failure, the processor enters and endless loop without resetting the watchdog timer. The processor remains in the loop until the watchdog timer causes a system reset. When a processor RAM tests fails, the processor reads and writes the failed address until reset. Upon any detected MUX Interface failure, the processor sets the BIT FAIL indicator, disables the failed MUX Interface, and then continues Initialization and then enters Normal mode.

At the end of either Cold 110 or Warm BIT 112, assuming no processor failures, Word 3 of the BIT Status aircraft message is updated to indicate the results of the test.

7.3.4 Diagnostic

The Diagnostic 114 process operates in the background and provides visibility to the ACTID's operational state and data collected by the various MUX Interfaces. This process also provides an operator with the ability to override preprogrammed modes and modify any data in ACTID memory.

The Diagnostic process provides commands for an operator to view and modify any location in the processor's memory or IO address space. These commands are described below.

b[yte] [[segment:]start$_{13}$offset [end$_{13}$offset]] [{=,+,−,¦,&,^} data[,data]]

w[ord] [[segment:]start$_{13}$offset [end$_{13}$offset]] [{=,+,−,¦,&,^} data[,data]]

i[ob] [start$_{13}$address [end$_{13}$address]] [{=,+,−,¦,&,^} data[, data]]

iow [start$_{13}$address [end$_{13}$address]] [{=,+,−,¦,&,^} data[, data]]

m[onitor] {on, of[f], f[ormat]} string [[segment:]offset [length]]

The byte and word commands read or write data from memory space a byte or word at a time, respectively, and display the results. The iob and iow commands are similar but read or write data from IO address space. The Monitor command controls and formats the continuous display of selected memory.

The segment option is a 16-bit number that specifies the segment portion of a memory address. The 16-bit start_offset and end_offset options specify the beginning and ending offset portions, respectively, of a memory address range. Similarly, the 16-bit start$_{13}$address and end$_{13}$address options specify the beginning and ending addresses, respectively of an IO address range.

The '=' operator option assigns the following data item(s) to the specified address range. When multiple data items are included, each data item is assigned to a sequential address. When an end$_{13}$offset or end$_{13}$address is specified, the last data item is used to fill all remaining addresses of the address range specified. The '+', '−',¦', '&', and '^' operators are equivalent to the 'C' '+=', '−=', ¦=','&=', and '^=' operators.

The monitor on and off commands perform the obvious. The monitor format command sets up the display parameters. This includes a string to precede the data, and the begin address and range of the data in memory.

7.3.5 Booter/Loader

The Booter/Loader 116 process 102 is the first process entered upon power-up, performs the minimum initialization 102 required, and then optionally enters a state which allows reprogramming the ACTID's operational software into ROM (Flash Electrically Erasable Read Only Memory).

7.4 Data Flow

The ACTID's primary function is that of multiplexer which is a data flow function.

With the exception of the aircraft-ACTID BIT messages, the ACTID performs no operations on the data and transparently moves selected data from one MUX Interface to another. This movement is handled in three steps. Data enters the ACTID from a MUX bus via one of the four MUX Interface devices. These devices handle all of the protocol of the bus and place the received data into shared memory for the processor. The processor then moves the data from RAM shared with the receiving MUX Interface to RAM shared with the transmitting MUX Interface. From there, the data leaves the ACTID via the transmitting MUX Interface which again handles all of the bus protocol.

7.4.1 Aircraft to ACT-R Pod Flow

Figure 2:
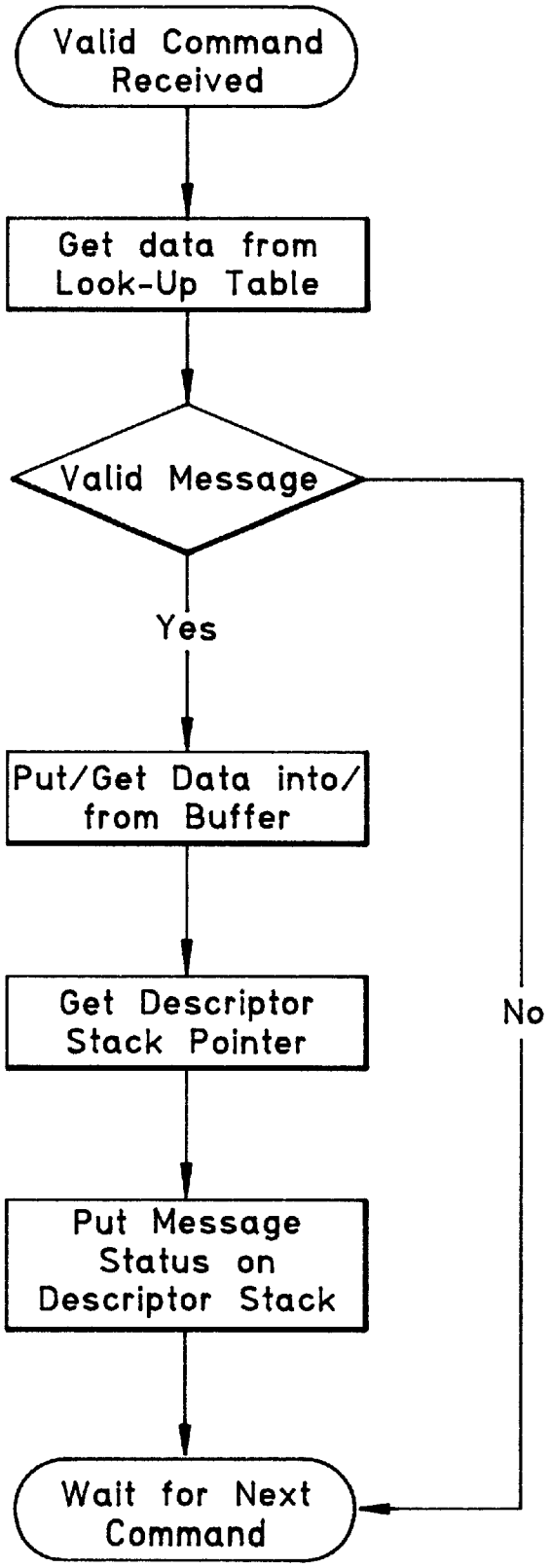
FIG. 2 is a flow chart of a MUX interface aircraft message transfer process according to the invention.
Figure 3:
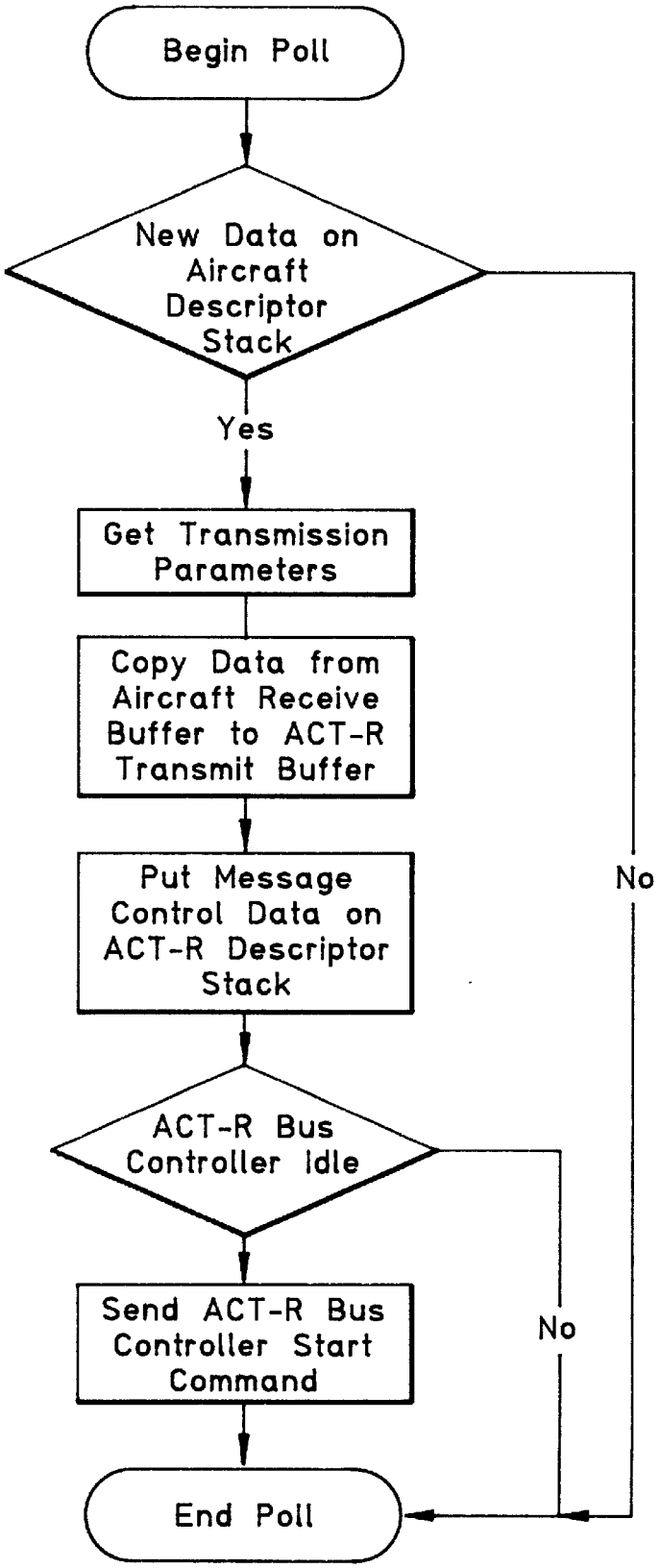
FIG. 3 is a flow chart of a processor aircraft to ACT-R message translation process according to the invention.
Figure 4:
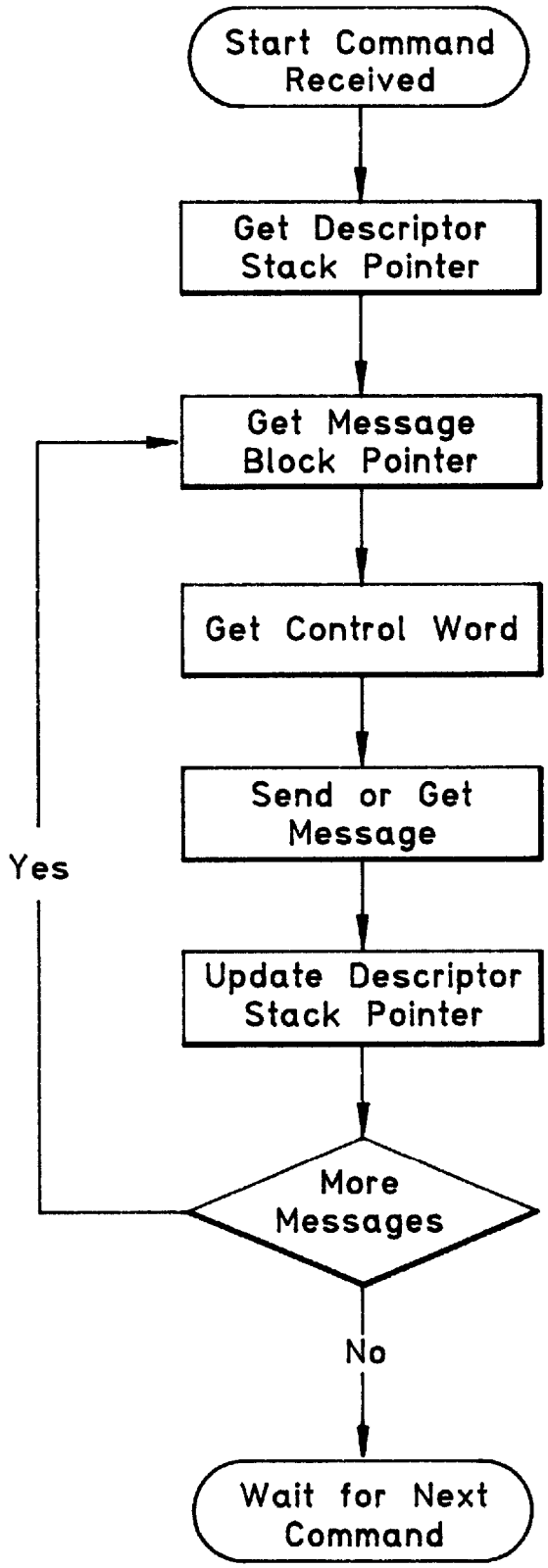
FIG. 4 is a flow chart of a MUX interface ACT-R message transfer process according to the invention.

The transfer of data from the aircraft to the ACT-R pod occurs in a sequence of three processes. The first process, illustrated in FIG. 2 and called the MUX Interface aircraft message transfer, is performed in hardware by an aircraft MUX Interface device. Upon completion of this process, the second process, illustrated in FIG. 3 and called the Processor Aircraft to ACT-R message translation, is performed in software by the ACTID processor. Finally, the third process, illustrated in FIG. 4 and called the MUX Interface ACT-R message transfer, is performed in hardware by the ACT-R MUX Interface device.

Figure 10:
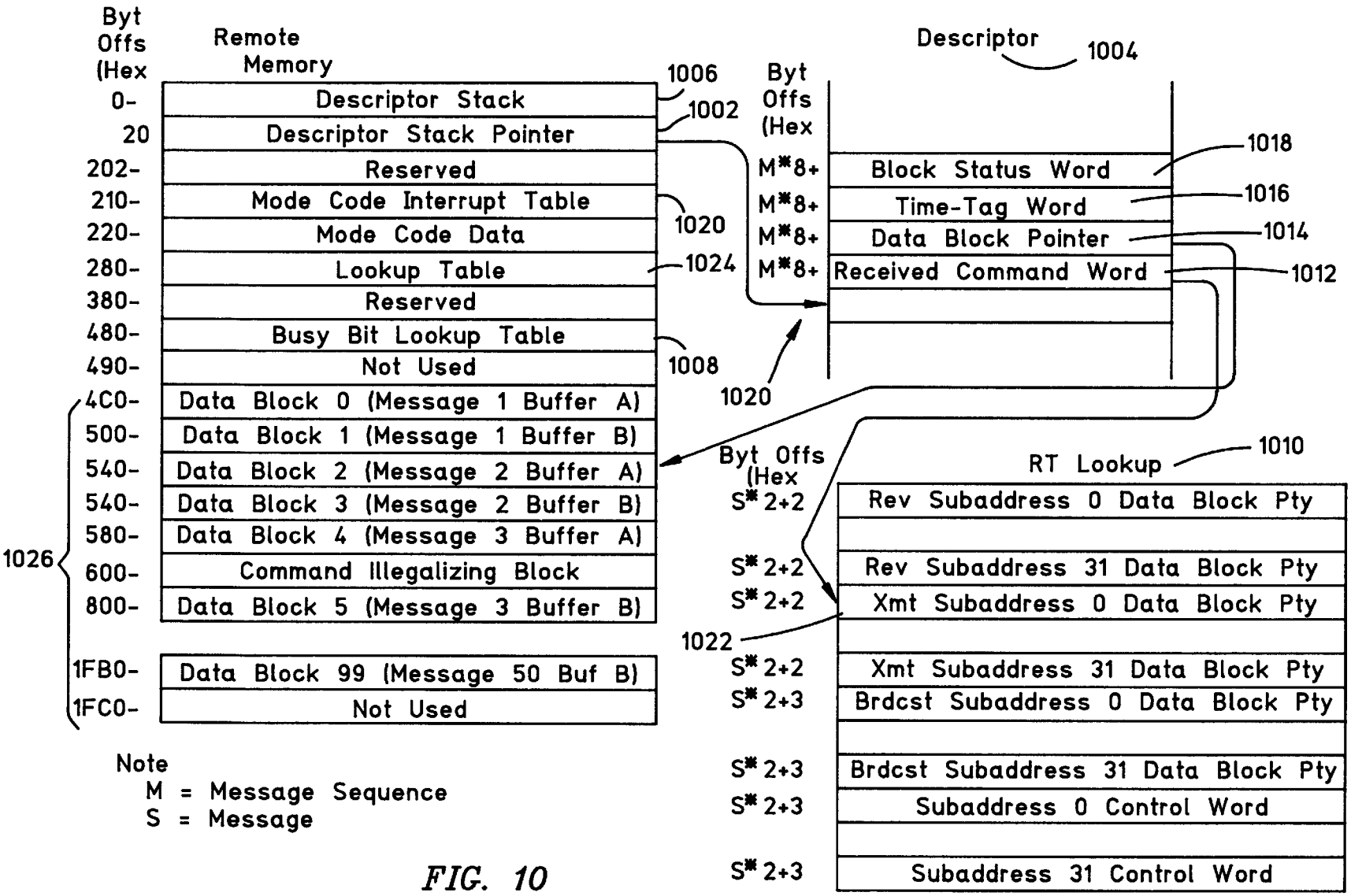
FIG. 10 is a diagram of a remote terminal data structure according to the invention.

The Aircraft Message Reception Process for Remote Terminals is summarized below. Refer to FIG. 10 for an illustration of the Remote Terminal data structure.

1) Read the appropriate Illegalization bit 1000 to control the RT's response to the message. The illegalization bit is selected using the message's RT Address (own vs. broadcast), Subaddress, Direction (T/R) and Word Count fields in the received command word.

2) Read the Descriptor Stack Pointer 1002 to access the RT Descriptor Block 1004 in the Descriptor Stack 1006.

3) Read the appropriate Busy bit 1008 to control the RT's response to the message. The busy bit is selected using the message's Subaddress, Direction (T/R), and Word Count fields in the received command word.

4) Read the Subaddress Control Word from the Subaddress Control Word portion of the RT Lookup Table 1010 to control where the data is put into shared memory and how to update pointers and status for subsequent messages.

5) Read the Data Block Address from the RT Lookup Table 1010 to control where data is put into shared memory. The Data Block Address is selected using the message's RT Address (own vs. broadcast), Subaddress, and Direction (T/R) fields in the received command word.

6) Write the received command word to the fourth location 1012 in the Descriptor Block 1004.

7) Write the Data Block Address to the third location 1014 in the Descriptor Block 1004.

8) Write the Time Tag Word to the second location 1016 in the Descriptor Block 1004.

9) Write the Block Status Word in the first location 1018 in the Descriptor Block 1004 with 4000h to indicate Start-of-Message (all other status bits cleared).

10) Increment the value of the Stack Pointer 1002 read in step 2 by four and write to the Stack Pointer location 1020.

11) Wait for completion of the message transfer.

12) Read the Subaddress Control Word and the Data Block Address from the RT Lookup Table 1010 to update the Data Block Address for the next message.

13) Write the Data Block Address in the RT Lookup Table 1010 with the updated address.

14) Write the Time Tag word to the second location 1016 of the Descriptor Block 1004.

15) Write the Block Status Word to the first location 1018 of the Descriptor Block 1004.

Figure 11:
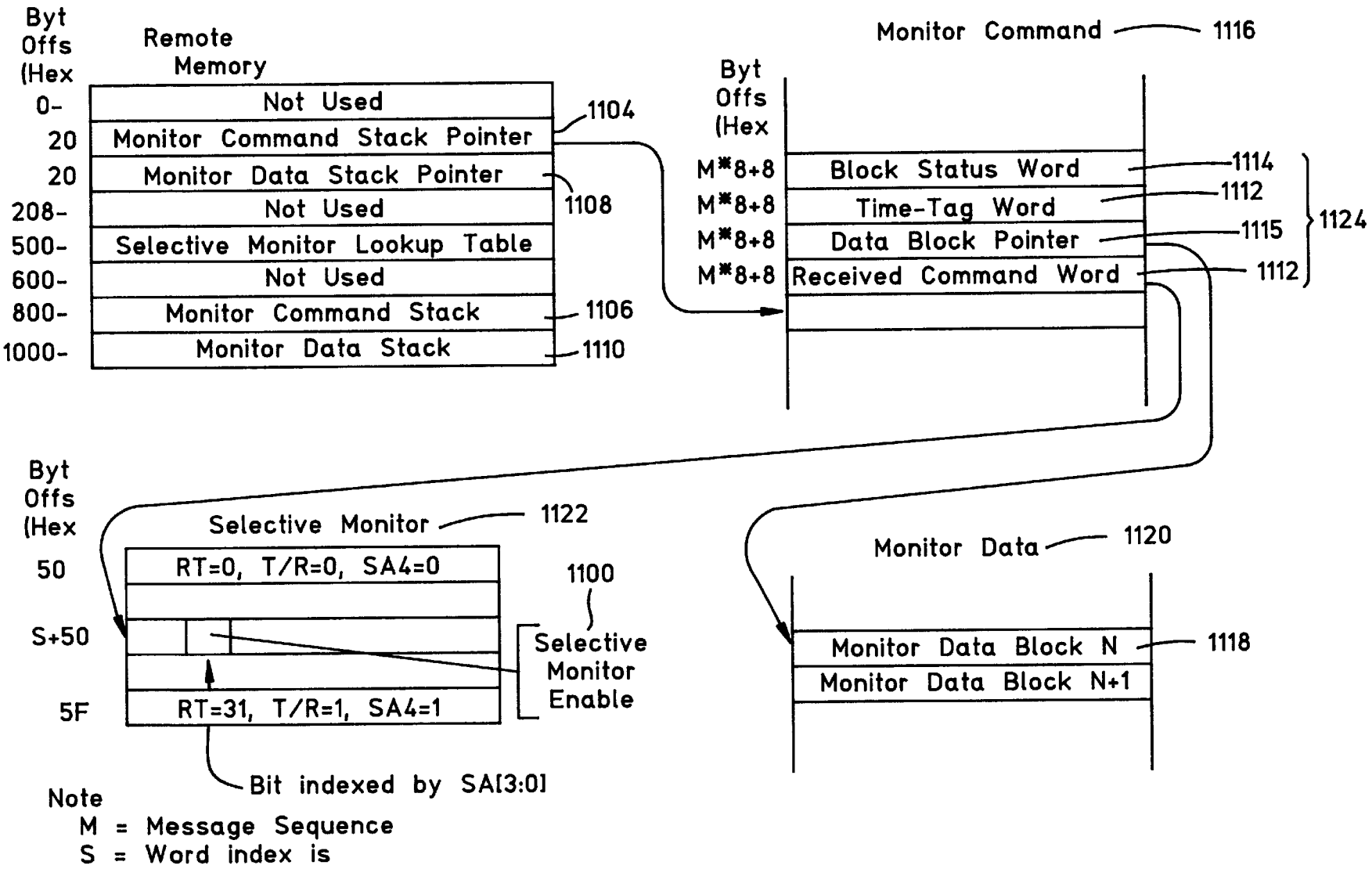
FIG. 11 is a diagram of a bus monitor data structure according to the invention.

The Aircraft Message Reception Process for Bus Monitors is summarized below. Refer to FIG. 11 for an illustration of the Monitor data structure.

1) Read the appropriate Selective Message Enable bit 1100 to control the BM's action on the message. The enable bit is selected using the message's RT Address, Subaddress, and Direction (T/R) fields in the received command word 1102.

2) Read the Monitor Command Stack Pointer 1104 to access the Descriptor Block in the Monitor Command Stack 1006.

3) Read the Monitor Data Stack Pointer 1108 to access the data block in the Monitor Data Stack 1110.

4) Write the Command Word to the fourth location 1102 in the Descriptor Block.

5) Write the Time Tag Word to the second location 1112 of the Descriptor Block.

6) Write the Block Status Word to the first location 1114 of the Descriptor Block.

7) Increment the Command Stack Pointer 1104 value read in step 2 by four and write to Command Stack Pointer location.

8) Wait for completion of the message transfer.

9) Write the value of the address of the last word stored in the Monitor Data Stack 1110 plus one to the Monitor Data Stack Pointer 1108.

10) Write the Time Tag Word to the second location 1112 of the Descriptor Block.

11) Write the Block Status Word to the first location 1114 of the Descriptor Block.

The Aircraft-to-ACT-R Message Translation Process is summarized below.

1) Read the value of the aircraft MUX Interface Stack Pointer and compare to old value to determine if new data received.

2) Read the value of the Block Status Word from 1114 the aircraft MUX Interface Descriptor Block 1116 to determine if new message is complete and without errors.

3) Read the value of the Data Block Address 1115 from the aircraft MUX Interface Descriptor Block 1116 to compute message index for Aircraft-to-ACT-R Translation Table.

4) Read the ACT-R subaddress from the Aircraft-to-ACT-R Translation Table to determine destination(s) of aircraft data.

5) Read the current time from the Time Tag 1112 registers of the aircraft and ACT-R MUX Interface devices and read the Time Tag from the second location of the aircraft MUX Interface Descriptor Block 1116.

6) Write the ACT-R Time Tag into the second location 1112 of the ACT-R Message. This Time Tag is (ACT-R MUX Interface register Time Tag—(aircraft MUX Interface register Time Tag—Time Tag from second location of the aircraft MUX Interface Descriptor Block)).

7) Read the Word Count from the received command word 1102 in the fourth location of the aircraft MUX Interface Descriptor Block 1116.

8) If ACT-R Subaddress is in the range 1 to 29 and the Word Count is less than 32, copy number of words as determined from Word Count from aircraft Data Block 1118 to ACT-R Data Block. The first aircraft word location corresponds to fourth ACT-R word location.

9) Else if ACT-R Subaddress is in the range 1 to 29 and the Word Count is equal to 32, copy first 31 words from aircraft Data Block 1118 to first ACT-R Data Block. The first aircraft word location corresponds to fourth ACT-R word location. Copy 32nd word from aircraft Data Block to fourth location in second ACT-R Data Block.

10) Else if ACT-R Subaddress is greater than 29 and the Word Count is less than 31, copy number of words as determined from Word Count from aircraft Data block 1118 to ACT-R Data Block. The first aircraft word location corresponds to fifth ACT-R word location.

11) Else if ACT-R Subaddress is greater than 29 and the Word Count is 31 or 32, copy first 30 words from aircraft Data Block 1118 to first ACT-R Data Block. First aircraft word location corresponds to fifth ACT-R word location. Copy last 1 or 2 words as determined from Word Count from aircraft Data Block 1118 to ACT-R Data Block beginning at fourth location.

12) Read the ACT-R MUX Interface Descriptor Stack Pointer 900 and Message Count 902 to determine the location of the next available descriptor block.

13) Write 0 to the Block Status Word 904 in the first location of the ACT-R Descriptor Block to initialize for subsequent polling.

14) Write the Message Block address 906 to the Message Block Pointer 908 in the fourth word of the of the ACT-R Descriptor Block.

15) Decrement the Message Count and write to the ACT-R MUX Interface Message Count 902 location.

16) If Message Count is not −1, start ACT-R Bus Controller operation by writing to ACT-R MUX Interface Start/Reset register.

Figure 9:
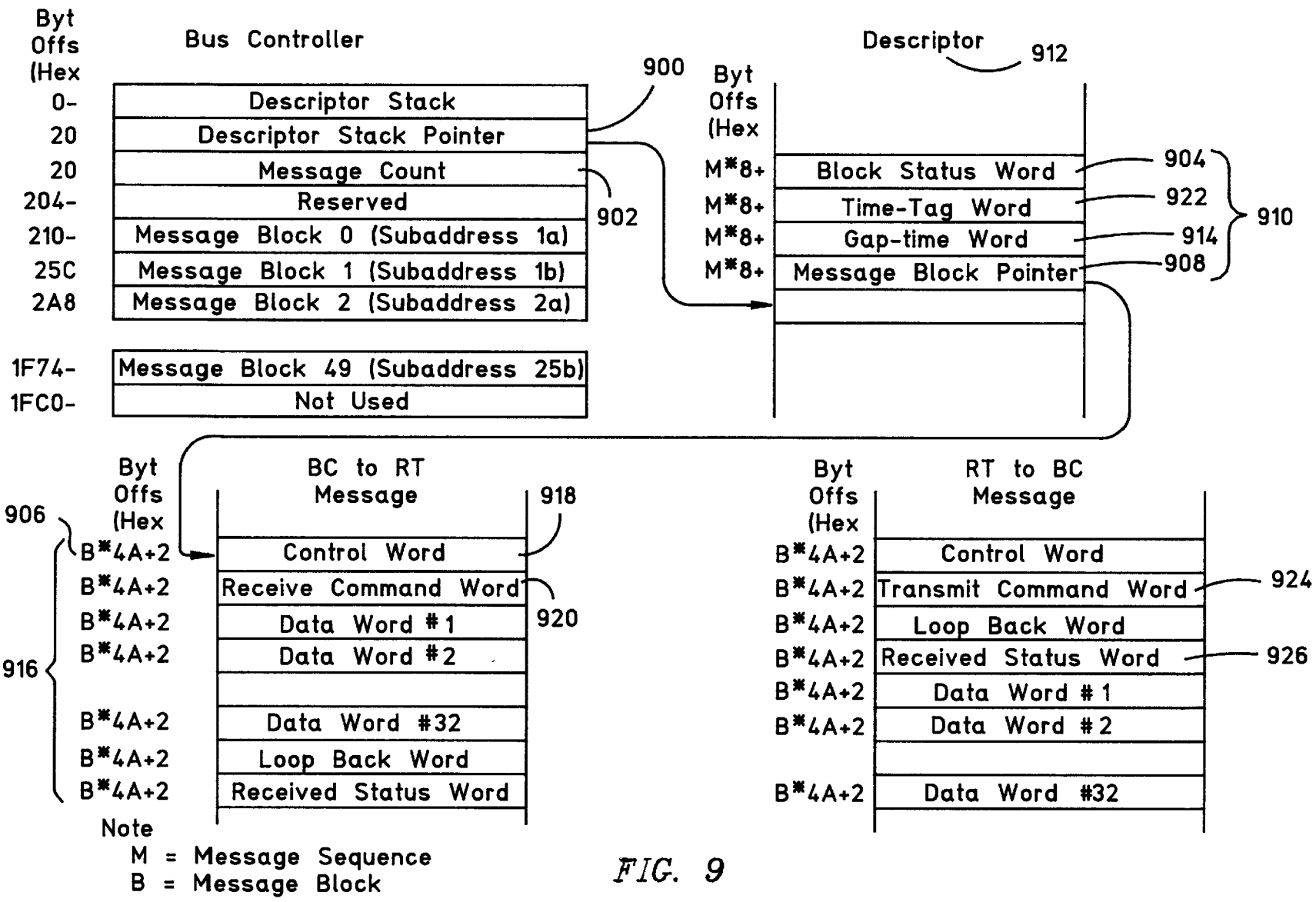
FIG. 9 is a diagram showing a bus controller data structure according to the invention.

The ACT-R Message Transmission Process for the Bus Controller is summarized below. Refer to FIG. 9 for an illustration of the Bus Controller data structure.

1) Read the Descriptor Stack Pointer 900 to access the first Descriptor Block 910 on the Descriptor Stack 912.

2) Read the Message Gap-Time 914 from the third location of the Descriptor Block 910 to control when to begin the following message.

3) Read the Message Block Pointer 908 from the fourth location of the Descriptor Block 910 to locate the beginning of the Message Block 916.

4) Read the Control Word 918 from the first location of the Message Block 916 to determine the message transfer characteristics.

5) Read the Command Word 920 from the second location of the Message Block 916.

6) Write the Time Tag Word 922 to the second location of the Descriptor Block 910.

7) Write the Block Status Word 904 to the first location of the Descriptor Block 910.

8) Wait for completion of the message transfer.

9) If the Message Word Count 902 is less than −1, increment the Message Word Count by 1 902.

10) Write the Time Tag Word 922 to the second location of the Descriptor Block 910.

11) Write the Block Status Word 904 to the first location of the Descriptor Block 910.

12) Write the Message Count Word 902 to the Message Count location.

13) Increment the Descriptor Stack Pointer 900 by 4 and write the updated value to the Descriptor Stack Pointer location.

7.4.2 ACT-R Pod to Aircraft Flow

Figure 5:
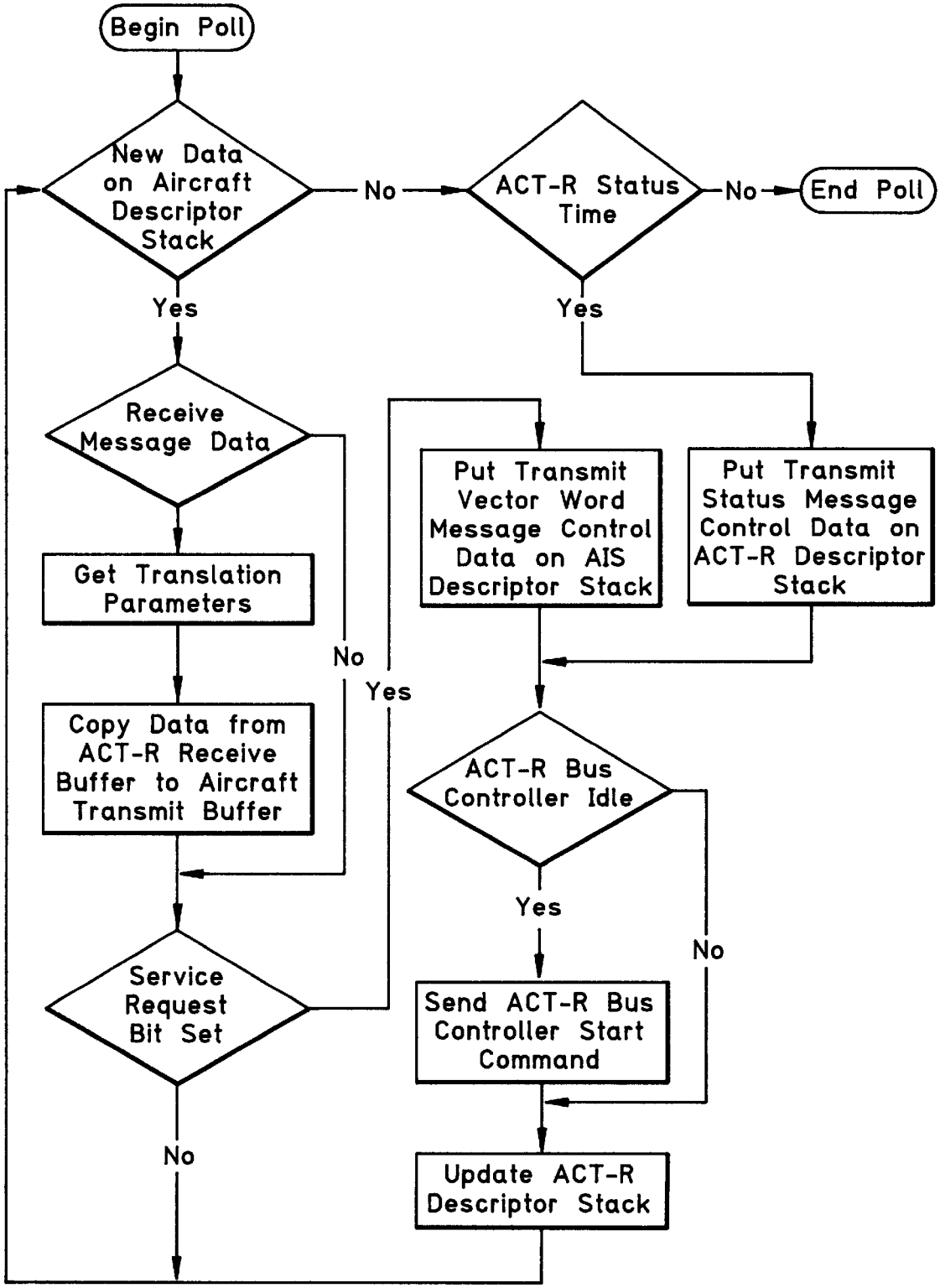
FIG. 5 is a flow chart of a processor ACT-R to aircraft message translation process according to the invention.

The transfer of data from the ACT-R pod to the aircraft occurs in a sequence of three processes. The first process, illustrated in FIG. 4 and called the ACT-R Message Transfer Process, is performed in hardware by the ACT-R MUX Interface device. Upon completion of this process, the second process, illustrated in FIG. 5 and called the Processor ACT-R to Aircraft message translation, is performed in software by the ACTID processor. Finally, the third process, illustrated in FIG. 2 and called the MUX Interface aircraft message transfer, is performed in hardware by an aircraft MUX Interface device.

The ACT-R Message Reception Process for the Bus Controller is identical to that for the ACT-R Message Transmission Process except for the direction of the data between the MUX Interface device and its shared RAM. The MUX Interface device writes data to its shared RAM.

The ACT-R-to-Aircraft Message Translation Process is summarized below:

1) Read the value of the ACTR MUX Interface Descriptor Stack Pointer 900 and compare to old value to determine if new data received.

2) If new data received, read the value of the Block Status Word 904 from the ACTR MUX Interface Descriptor Block 910 to determine if new message is complete and without errors.

3) Read the value of the Data Block Address 908 from the ACTR MUX Interface Descriptor Block 910 to compute message index for ACT-R-to-Aircraft Translation Table 800.

4) Read the Aircraft MUX Interface ID 802 and Aircraft Message Index 804 from the ACT-R-to-Aircraft Translation Table 800 to determine destination of aircraft data.

5) Read Data Block Pointer 1022 from aircraft RT Lookup Table 1010 and modify to select inactive buffer.

6) Read received Command Word 924 from second location of ACT-R Message Block to determine ACT-R message Word Count.

7) If Type 2 ACT-R pod to ACTID message 700, copy number of words, as determined by the ACT-R message Word Count, to the aircraft inactive Data Block beginning with first word of ACT-R message. The first ACT-R word corresponds with first aircraft message word.

8) Else if Type 2*a* ACT-R pod to ACTID message 702, copy number of words less one as determined by the ACT-R message Word count to the aircraft inactive Data Block beginning with second word of ACT-R message. The second ACT-R word corresponds with first aircraft message word.

9) Else if Type 2*b* ACT-R pod to ACTID message 704, copy second ACT-R message word to the aircraft inactive Data Block. The second ACT-R word corresponds with 32nd aircraft message word.

10) If Type 2 700 or Type 2*b* ACT-R message 704, write inactive Data Block Pointer to aircraft RT Lookup Table to activate inactive Data Block.

11) Read Status Word 926 from ACT-R Message Block to test the Service Request bit. The location of the Status Word is in word location 3 plus the Word Count.

12) If the Service Request bit is set to '1', write Transmit Vector Word message descriptor block to top of ACT-R Descriptor Stack 912.

13) Decrement the Message Count 902 and write to the ACT-R MUX Interface Message Count.

14) If Message Count is −2, start ACT-R Bus Controller operation by writing to ACT-R MUX Interface Start/Reset register. This is the last step of the process.

15) Else if (from step 2) ACT-R Status Time >1 ms, write Transmit Status message descriptor block to top of ACT-R Descriptor Stack 912. Go to step 13.

The Aircraft Message Transmission Process for the Remote Terminal is identical to the Remote Terminal Message Reception Process with the following exceptions:

1) The MUX Interface device reads the data from shared RAM rather than writing to it.

2) The Double Buffering Enable bit in the Subaddress Control Word from the Subaddress Control Word portion of the RT Lookup Table is not used for transmit messages. The processor controls the double buffering process directly.

3) The MUX Interface device will not modify the Data Block Address in the RT Lookup Table for transmit messages.

7.4.3 Diagnostic Flow

The flow of diagnostic data is between ACTID memory and a Host Terminal or Computer via the ACTID's Diagnostic Serial Port. The serial port is interrupt driven and has separate interrupt routines for the receive and transmit processes. The receive interrupt routine simply puts all received characters into a buffer until a carriage return is received. Once the carriage return is received, the command is checked for syntax errors and then processed.

If the command contains data to be written (using '=' operator) to memory or IO, the data strings in the command operands are converted from ASCII to binary and then written. If the command contains an arithmetic or logical operator: 1) the data strings in the command operands are converted from ASCII to binary, 2) the data at the specified location is read, 3) the operation performed using the data read from memory or IO, the command operand, and the command operator, 4) and then the result is written back to the specified location.

If the command is to be read data from memory or IO, the binary data is read from the specified locations, converted into ASCII strings and then written to the Diagnostic Serial Port transmit buffer.

If the monitor command is used, binary data from the specified location is read, converted to an ASCII string, and then written to the Monitor buffer. No more data is read from memory or written to the Monitor buffer until the Diagnostic Serial Port transmit buffer is empty. When the Diagnostic Serial Port transmit buffer is empty and the Monitor buffer is not empty, the contents of the Monitor buffer is moved to the Diagnostic Serial Port transmit buffer. When the Monitor buffer is empty more binary data is read and processed.

7.5 Data Elements 7.5.1 Data Message Formats

At this time, the AISI(K) processes 20 aircraft MUX commands. Of these 20, the ACTID will process 18 aircraft messages for the ACT-R pod. The two BIT messages (aircraft types 20 and 36) are dedicated to the ACTID and will not affect the ACT-R pod. Table 1 summarizes these messages.

7.5.1.1 Aircraft Messages 7.5.1.1.1 ACTID Transparent Messages

Figure 6:
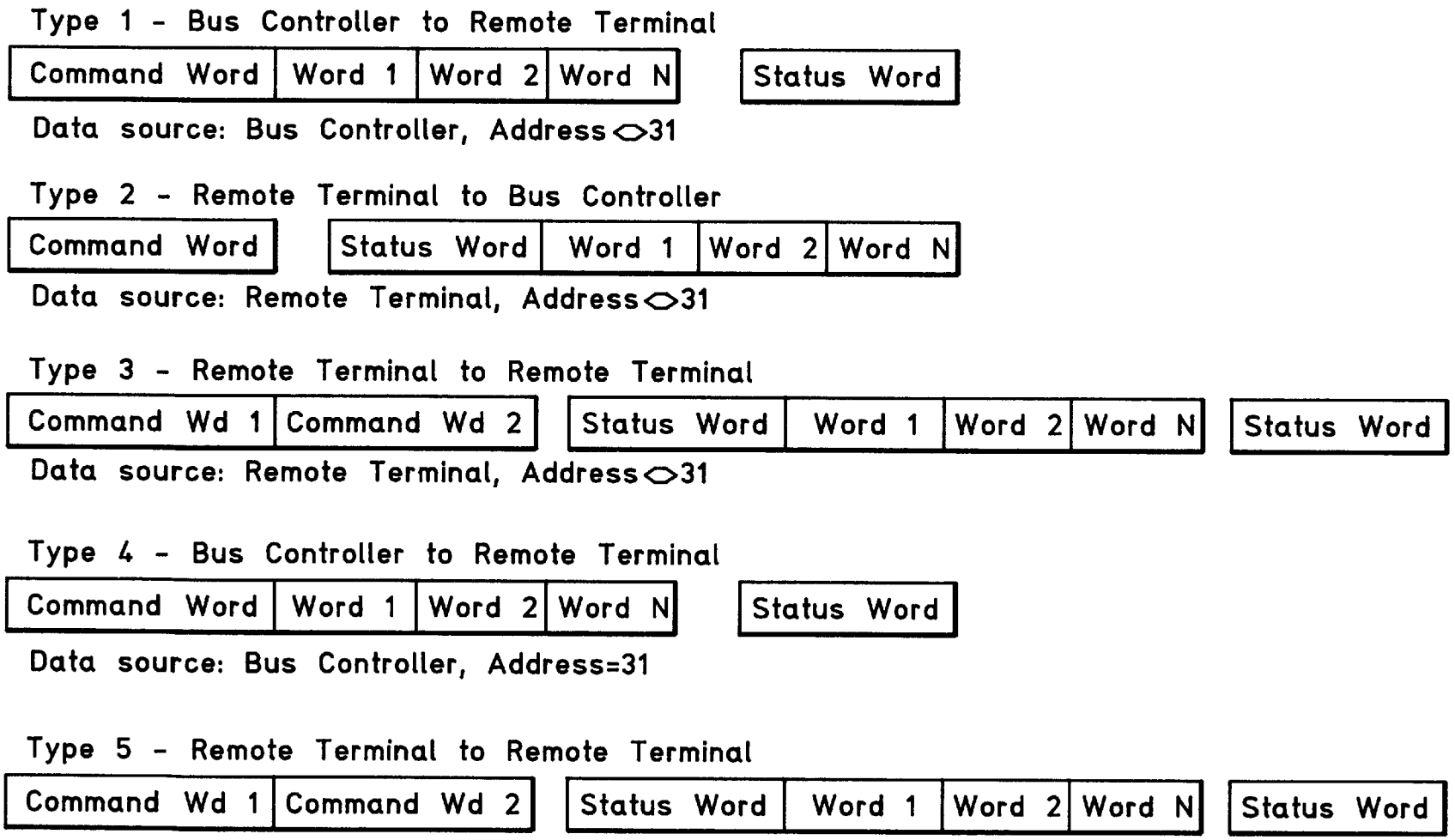
FIG. 6 is a diagram of aircraft general message formats according to the invention.

There are ten possible message types at the Aircraft MUX Interfaces. Five of these may be dedicated to the ACTID and use the ACTID RT address. The other five types are messages which the ACTID only monitors and do not contain an RT address which the ACUD will actively respond to. The five general formats, which are illustrated in FIG. 6, are:

1) Type 1—The direction is BC-to-RT. In the Command Word, T/R=0, and RT Address <> 31.
2) Type 2—The direction is RT-to-BC. In the Command Word, T/R=1, and RT Address <> 31.
3) Type 3—The direction is RT-to-RT. In the first Command Word, T/R=0, and RT Address <> 31. In the second command word, T/R=1, and RT Address <> 31.
4) Type 4—The direction is BC-to-RT. In the Command Word, T/R=0, and the RT Address=31.
5) Type 5—The direction is RT-to-RT. In the first Command Word, TIR=0, and RT Address=31. In the second command word, T/R=1, and RT Address <> 31.

7.5.1.1.2 ACTID Dedicated Messages

The ACTID responds, to the aircraft messages dedicated for the AISI(K) test, just as the aircraft would expect an AISI(K) to respond. The two aircraft messages are Types and 36. Type 36 is the aircraft command to the ACTID to initiate Warm Bit or to terminate Warm BIT. Type is the aircraft command to the ACTID to transmit its BIT results.

Message Type 20:

Command Word

RT Address (Bits 0–4)=24

T/R (Bit 5)=1

Subaddress (Bits 6–10)=31

Word Count (Bits 11–15)=3–32

Status Word

RT Address (Bits 0–4)=24

Message Error (Bit 5)=
- 0—No error
- 1—Error

Unused Status Bits (Bits 6–15)=0

Word 1

Hardware Configuration (Bits 0–7)=
- 1—Initial version
- 2–255—Undefined

Software Configuration (Bits 8–15)=
- 0–1—Undefined
- 2—Initial version
- 3–255—Undefined Word 2

Terminal Reply Test Word (Bits 0–15)=
- Terminal Test Word from ACTID BIT Command message, word 2.

Word 3

In Test (Bit 0)=
- 0—BIT not being performed
- 1—BIT being performed

Go/Nogo (Bit 1)=
- 0—No fault
- 1—Fault

BIT Cmp (Bit 2)=
- 0—BIT not complete
- 1—BIT complete

Spare Bits (Bits 3–7)=0

DL LPBK (Bit 8)=0

Spare Bit (Bit 9)=0

RTC Out (Bit 10)=
- 0—Pass
- 1—Fail

RTC In (Bit 11)=
- 0—Pass
- 1—Fail

RTB Out (Bit 12)=
- 0—Pass
- 1—Fail

RTB In (Bit 13)=
- 0—Pass
- 1—Fail

RTA Out (Bit 14)=
- 0—Pass
- 1—Fail

RTA In (Bit 15)=
- 0—Pass
- 1—Fail

Message Type 36:

Command Word

RT Address (Bits 0–4)=24

T/R (Bit 5)=0

Subaddress (Bits 6–10)=30

Word Count (Bits 11–15)=3–32

Word 1

BIT I/S (Bit 0)=

0—Terminate BIT Mode

1—Initiate BIT Mode

Spare Bits (Bits 1–114)=0

Inflight (Bit 15)=

0—Weight on Wheels Switch Closed

1—Weight on Wheels Switch Open

Word 2

Terminal Test Word (Bits 0–15)=

Various from F/A-18 Mission computer

BB8Ah from ACTID Test Set

Status Word

RT Address (Bits 0–4)=24

Message Error (Bit 5)=

0—No error

1—Error

Unused Status Bits (Bits 6–15)=0

7.5.1.2 ACT-R Messages

There are only two general message types at the ACT-R MUX Interface. The ACT-R MUX Interface in the ACTID is a Bus Controller and dedicates both types of messages to the ACT-R pod's RT address. However, the ACTID adds additional information to the ACT-R messages resulting in three variations of each general type.

Figure 7:
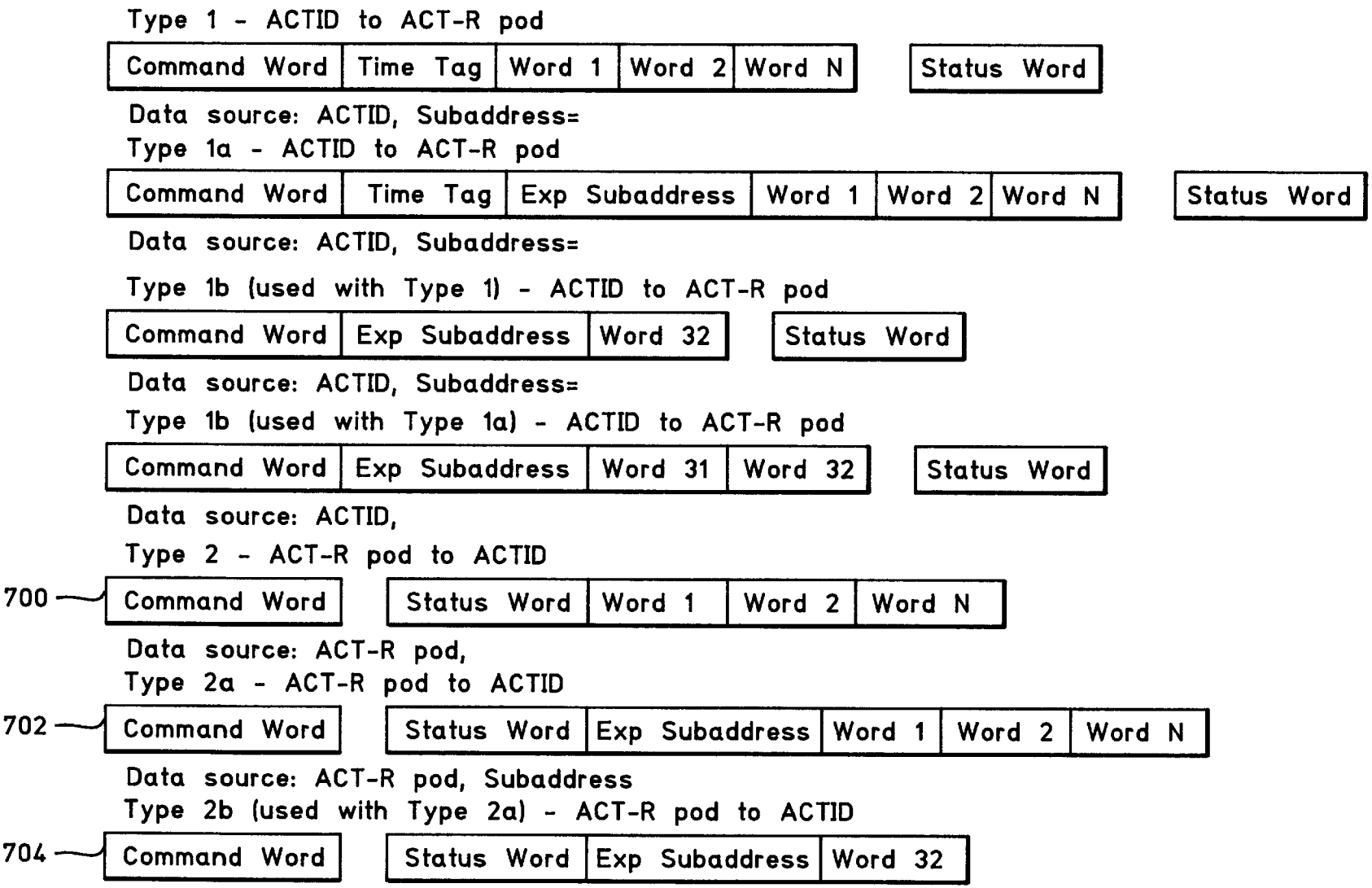
FIG. 7 is a diagram of ACT-R general message formats according to the invention.

The ACTID not only remaps the aircraft message's addresses, it also adds timing information so that the ACT-R pod can determine how much latency the ACTID added to the message information from the aircraft. As the ACTID must potentially remap 3*(210) different aircraft messages, the ACTID may expand the message ID from the Subaddress field in the Command Word into a Data Word in the message itself. These modified formats are illustrated in FIG. 7** and described below.

1) Type 1—Used for first 29 defined aircraft to ACT-R messages. Contains up to 31 Data Words from aircraft message. 32nd Data Word is sent in Type 1*b* message. The direction is BC-to-RT. In the Command Word:

T/R=0,

RT Address=3,

Subaddress=1–29,

Word 1=Time Tag,

Words 2 to N=aircraft message Words 1 to N–1.

2) Type 1*a*—Used for aircraft to ACT-R pod messages defined after first 29.

Contains up to 30 Data Words from aircraft message. 31st and 32nd Data Words are sent in Type 1*b* message. The direction is BC-to-RT. In the Command Word:

T/R=0,

RT Address=3,

Subaddress=30,

Word 1=Time Tag,

Word 2=Expanded Subaddress,

Words 3 to N=aircraft message Words 1 to N–2.

3) Type 1*b*—Used for overflow data from message Types 1 and 1*a*. The direction is BC-to-RT. In the Command Word:

T/R=0,

RT Address=3,

Subaddress=30,

Word 1=Expanded Subaddress,

Word 2=aircraft message Word 32 (preceded by Type 1 message).

Words 2 to 3=aircraft message Words 31 to 32 (preceded by Type 1*a* message).

4) Type 2—Used for first 29 defined ACT-R pod to aircraft messages. The direction is RT-to-BC. In the Command Word:

T/R=0,

RT Address=3,

Subaddress=1–29,

Words 1 to N=aircraft message Words 1 to N.

5) Type 2*a*—Used for ACT-R pod to aircraft messages defined after first 29.

Contains up to 31 Data Words for aircraft message. 32nd Data Word is sent in Type 2*b* message. The direction is RT-to-BC. In the Command Word:

T/R=0,

RT Address=3,

Subaddress=30,

Word 1=Expanded Subaddress,

Words 2 to N=aircraft message Words 1 to N–1.

6) Type 2*b*—Used for overflow data from Type 2 message. The direction is RT-to-BC. In the Command Word:

T/R=0,

RT Address=3,

Subaddress=30,

Word 1=Expanded Subaddress,

Word 2=aircraft message Word 32.

7.5.2 Message Translation

Figure 8:
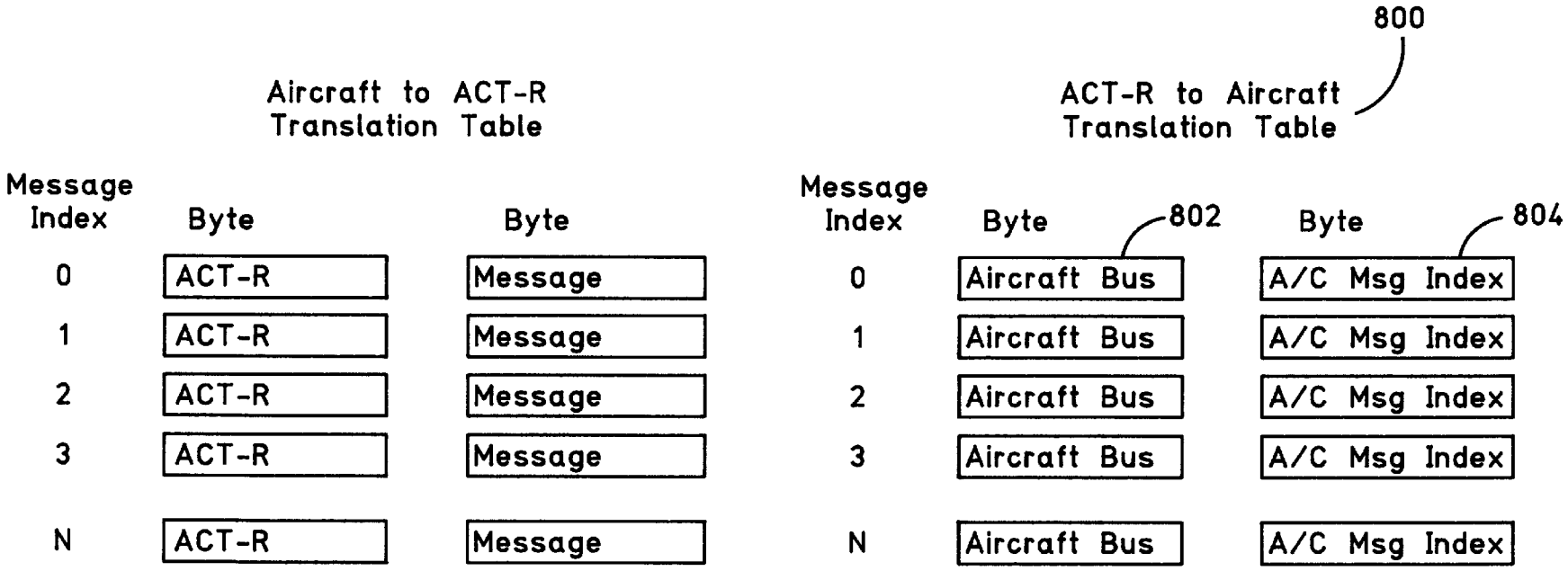
FIG. 8 is a diagram of translation table structures according to the invention.

There are four message translation look-up tables used to translate messages received by one MUX and transmitted from another. There is one look-up table structure used for each of the three aircraft MUX Interfaces and another look-up table structure used for the ACT-R MUX Interface. FIG. 8 shows the structures of these tables.

7.5.3 Data Memory Structures

The data produced or used by a MUX Interface device and processed by the ACTID processor is located in shared memory residing on the MUX Interface device. This data is located in data structures understood by both the MUX Interface device and the ACTID processor. There are four data structures defined—one each for Bus Controller, Remote Terminal, Selective Bus Monitor, and combination Remote Terminal/Selective Bus Monitor.

All data structures share common data elements such as stacks, data blocks, and pointers. The stacks are used to hold sequential event information. A Bus Controller uses a stack to hold Descriptor Blocks which sequentially link messages to be processed. A Remote Terminal or Bus Monitor uses stacks to save status and link information about sequentially received or transmitted messages. The Descriptor Blocks contain pointers to Data Blocks which contain message data. Bus controllers use Data Blocks to also hold additional status and control information. Remote Terminals and Bus Monitors also use lookup tables to control the response to messages based on the contents of the message's Command Word.

7.5.3.1 Bus Controller

FIG. 9 illustrates the data structure used by the Bus Controller. It has a Descriptor Stack, Descriptor Stack Pointer, Message Counter, and many Data Blocks. The Descriptor Stack Pointer points to 8-byte Descriptor Blocks located on the Descriptor Stack. These Descriptor Blocks contain status and control information and most importantly a pointer to the message Data Block to be processed. The Message Count field indicates the number of Descriptor Blocks on the Descriptor Block Stack.

7.5.3.2 Remote Terminal

FIG. 10 illustrates the data structure used by the Remote Terminal. It has a Descriptor Stack 1004, Descriptor Stack Pointer 1002, Mode Code Interrupt Table 1020, RT Lookup Table 1024, Busy Bit Lookup Table 1008, and many Data Blocks 1026.

The Descriptor Stack Pointer 1002 points to 8-byte Descriptor Blocks located on the Descriptor Stack 1004. These Descriptor Blocks contain status information and a pointer to the message Data Block processed.

The Mode Code Interrupt Table 1020 controls the MUX Interface's interrupt response to all Mode Codes. The Mode Code Data fields contain the single word of data used with some of the various Mode Code commands.

The RT Lookup Table 1024 contains the pointer to the various Data Blocks dedicated to each transmit, receive, and broadcast Subaddress. The RT Lookup Table 1024 also contains the receive Subaddress control parameters.

The Busy Bit Lookup Table 1008 partially defines the state of the Busy Bit used in the Status Word for each transmit, receive, or broadcast Subaddress.

The Command Illegalizing Block 1000 is a Lookup Table used to disable the Remote Terminal's response to each individual transmit, receive, or broadcast Subaddress.

7.5.3.3 Bus Monitor

FIG. 11 illustrates the data structure used by the Bus Monitor. It has a Monitor Command Stack 1116, Monitor Command Stack Pointer 1104, Monitor Data Stack 1120, Monitor Data Stack Pointer 1108, and Selective Monitor Lookup Table 1122.

The Monitor Command Stack Pointer 1104 points to 8-byte Descriptor Blocks 1124 located on the Monitor Command Stack 1116. These Descriptor Blocks contain status information and a pointer to the message Data Block (in the Monitor Data Stack) processed.

The Monitor Stack Pointer 1108 points to a variable length Data Block located on the Monitor Data Stack 1128. The Data Blocks contain the data from the message monitored.

The Selective Monitor Lookup Table 1122 contains a bit for each combination of RT Address, Subaddress, and Direction used by the MUX Interface device to selectively capture messages receive, or broadcast Subaddress.

7.5.3.4Remote Terminal/Bus Monitor

Figure 12:
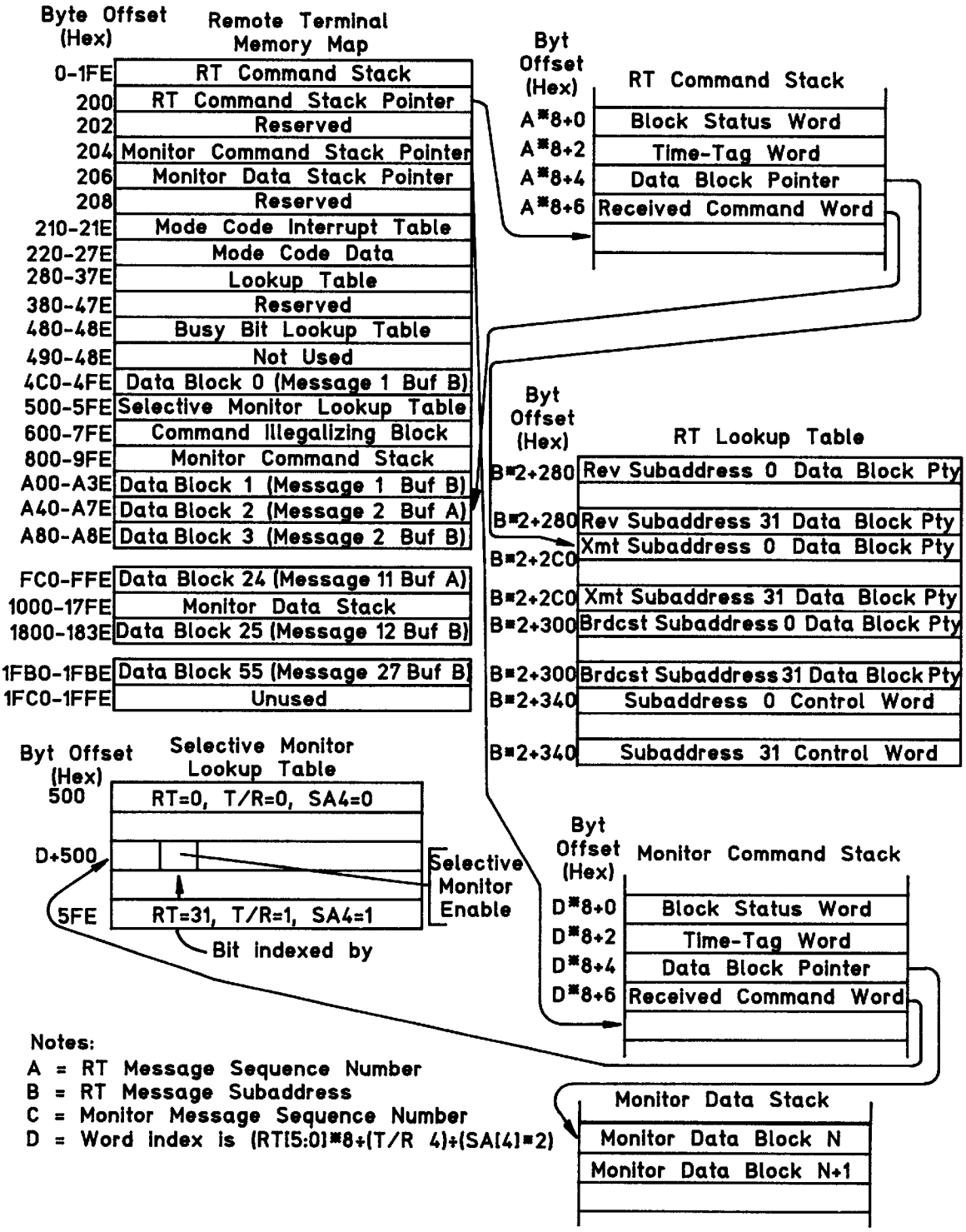
FIG. 12 is a diagram of a remote terminal/bus monitor data structure according to the invention.

The Remote Terminal/Bus Monitor Data Structure illustrated in FIG. 12 is simply a combination of the Remote Terminal and Bus Monitor Data Structure with the exception that memory for the Remote Terminal and Bus Monitor Data Blocks are reallocated approximately evenly.

7.6 Maintenance

The ACTID has a few features to enhance its maintainability. There are several tests which will detect most hardware related failures. There is also a built-in ability to download into Flash EPROM the latest software revision.

7.6.1 Built-in-Test

The two Built-in-Tests (Cold and Warm) provide a good indicator of the health of the ACTID. While the ACTID only provides a BIT Pass/Fail indicator, additional BIT information is available via the diagnostic port. Upon completion of Cold BIT, the processor outputs the results of the MUX Interface tests to the diagnostic port. If a processor RAM or ROM failure is detected, the processor stops and waits for the watchdog timer to cause a reset.

7.6.2 Software Updates

The Software program may be updated via the diagnostic port. The software enters a Loader routine if a BREAK condition is detected at the input of the Diagnostic port immediately after the processor comes out of the reset state, otherwise the processor begins Cold BIT.

The resident Loader downloads new programs into the processor's RAM. A new program is loaded into Flash EPROM by first loading into RAM a 'Flash Loader' program. Then the application program is loaded using the Flash Loader program. The resident Loader program does not have the capability to modify the Flash EPROM.

Other Embodiments

While there have been shown what are presently considered to be preferred embodiments of the invention, it will be apparent to those skilled in the art that various changes and modifications can be made herein without departing from the scope of the invention as defined by the appended claims.

APPENDIX

Table 1 - Aircraft Message Summary

| Msg Num | Aircraft Msg Type | Message Name | A/C MUX | Num Data Words in Aircraft Message | ACTID Aircraft Interface MUX Type | ACT-R Message Source | ACT-R Message Subaddress |
|---|---|---|---|---|---|---|---|
| 1 | 5 | ACTID to ALR-67 | EW | 28 | RT | ACT-R | 1 |
| 2 | 6 | ACTID to ALR-67 | EW | 14 | RT | ACT-R | 2 |
| 3 | 20 | ACTID to MC | AV1 | 3 | RT | N/A | |
| 4 | 21 | ALR-67 to ACTID | EW | 32 | RT | ACTID | 1 & 1B |
| 5 | 22 | ALR-67 to ACTID | EW | 1 | RT | ACTID | 2 |
| 6 | 34 | MC to ACTID | AV1 | | RT | ACTID | 3 |
| 7 | 35 | MC to ACTID | AV1 | | RT | ACTID | 4 |
| 8 | 36 | MC to ACTID | AV1 | 2 | RT | N/A | |
| 9 | 37 | ADC to MC | AV1 | 28 | BM | ACTID | 5 |
| 10 | 38 | CSC to MC | AV1 | 9 | BM | ACTID | 6 |
| 11 | 40 | MC to SMS | AV1 | 0 | BM | ACTID | 7 |
| 12 | 41 | SMS to MC | AV1 | 2 | BM | ACTID | 8 |
| 13 | 42 | SMS to MC | AV1 | 11 | BM | ACTID | 9 |
| 14 | 43 | SMS to MC | AV1 | 8 | BM | ACTID | 10 |
| 15 | 44 | SMS to MC | AV1 | 22 | BM | ACTID | 11 |
| 16 | 46 | MC to SMS | AV1 | 14 | BM | ACTID | 12 |
| 17 | 54 | HARM CLC to MC | AV1 | 4 | BM | ACTID | 13 |

APPENDIX-continued

Table 1 - Aircraft Message Summary

| Msg Num | Aircraft Msg Type | Message Name | A/C MUX | Num Data Words in Aircraft Message | ACTID Aircraft Interface MUX Type | ACT-R Message Source | ACT-R Message Subaddress |
|---|---|---|---|---|---|---|---|
| 18 | 85 | INS to MC | AV2 | 29 | BM | ACTID | 14 |
| 19 | 91 | Radar to MC | AV2 | 28 | BM | ACTID | 15 |
| 20 | 92 | Radar to MC | AV2 | 27 | BM | ACTID | 16 |

TABLE 2

Power Connector (AISI K) Contact Assignments

| Contact Number | Function |
|---|---|
| 1 | N/C |
| 2 | N/C |
| 3 | N/C |
| 4 | N/C |
| 5 | N/C |
| 6 | N/C |
| 7 | N/C |
| 8 | N/C |
| 9 | Chassis Ground |
| 10 | DC Return |
| 11 | +28 Vdc |
| 12 | AC Return |
| 13 | 115 Vac Power |

N/C = No connect

TABLE 3

MUX Bus Connector (AISI K) Contact Assignments

| Contact Number | Function | Remarks |
|---|---|---|
| 1 | MUX-1X Hi | |
| 2 | MUX-1X Lo | |
| 3 | Shield Ground | For MUX-1X & 1Y |
| 4 | MUX-1Y Hi | |
| 5 | MUX-1Y Lo | |
| 6 | Output Data | |
| 7 | Output Data | |
| 8 | MUX-2X Hi | |
| 9 | MUX-2X Lo | |
| 10 | Shield Ground | For MUX-2X & 2Y |
| 11 | MUX-2Y Hi | |
| 12 | MUX-2Y Lo | |
| 13 | MUX-3X Hi | EW Bus |
| 14 | MUX-3X Lo | EW Bus |
| 15 | Shield Ground | For MUX-3X & Data output |
| 16 | MUX-5Y Hi | (F-18 Lot 12 Block 29 & Sub) |
| 17 | MUX-5Y Lo | (F-18 Lot 12 Block 29 & Sub) |
| 18 | MUX-5X Hi | (F-18 Lot 12 Block 29 & Sub) |
| 19 | MUX-5X Lo | (F-18 Lot 12 Block 29 & Sub) |
| 20 | Shield Ground | For Equipment Ready A & B |
| 21 | Equipment Ready-A | |
| 22 | Equipment Ready-B | |

TABLE 4

61P-F001A PIN ASSIGNMENT

| Pin No | Wire # | Wire Type | Signal |
|---|---|---|---|
| 1–9 | | | Not Used |
| 10 | A277A-26 | M27500A26RC2S | Handoff High Station 2 |
| 11 | A278A-26 | M27500A26RC2S | Handoff Low Station 2 |
| 12 | | | Not Used |

TABLE 4-continued

61P-F001A PIN ASSIGNMENT

| Pin No | Wire # | Wire Type | Signal |
|---|---|---|---|
| 13 | | M27500A26RC2S | Station 3 Audio Low |
| 14 | | M27500A26RC2S | Station 5 Audio Low |
| 15–17 | | | Not Used |
| 18 | A278A-26 | M27500A26RC2S | Handoff Low Station 3 |
| 19 | ZZ54A-22 | M22759/11-22-5 | Shield Ground |
| 20 | A262A-26 | M27500A26RC2S | Handoff Low |
| 21 | A303A-26 | M27500A24RC1S | Lower Threshold/PD Station 7 |
| 22 | | M27500A26RC2S | Station 3 Audio High |
| 23 | | M22759/11-22-5 | Shield Ground |
| 24 | | M27500A26RC2S | Station 5 Audio High |
| 25–27 | | | Not Used |
| 28 | A295A-26 | M27500A26RC2S | Handoff High Station 7 |
| 29 | A286A-26 | M27500A26RC2S | Handoff High Station 3 |
| 30 | A261A-26 | M27500A26RC2S | Handoff High |
| 31 | A270A-26 | M27500A24RC1S | Lower Threshold/PD |
| 32 | ZZ55A-22 | M22759/11-22-5 | Shield Ground |
| 33 | A314A-26 | M27500A24RC1S | Lower Threshold/PD Station 8 |
| 34 | | M27500A26RC2S | Station 7 Audio High |
| 35 | | M27500A26RC2S | Station 7 audio Low |
| 36 | | | Not Used |
| 37 | A297A-26 | M27500A26RC2S | AZ Left Station 7 |
| 38 | A298A-26 | M27500A26RC2S | AZ Right Station 7 |
| 39 | ZZ56A-22 | M22759/11-22-5 | Shield Ground |
| 40 | A296A-26 | M27500A26RC2S | Handoff Low Station 7 |
| 41 | U503F-26 | 10595 | Avionics Bus 1Y High |
| 42 | U501AA- | 10595 | Avionics Bus 1X High |
| 43 | A285A-26 | M27500A24RC1S | Lower Threshold/PD Station 2 |
| 44 | A292A-26 | M27500A24RC1S | Lower Threshold/PD Station 3 |
| 45 | A704A-26 | M27500A26RC2S | Launch Initiate B (Radar) |
| 46 | A704A-SH | M22759/11-22-5 | Shield Ground |
| 47 | | M22759/11-22-5 | 28 Vdc No. 2 Power control Relay |
| 48 | A3083-26 | M27500A26RC2S | AZ Left Station 8 |
| 49 | ZZ57A-22 | M22759/11-22-5 | Shield Ground |
| 50 | A306A-26 | M27500A26RC2S | Handoff High Station 8 |
| 51 | A307A-26 | M27500A26RC2S | Handoff Low Station 8 |
| 52 | U504F-26 | 10595 | Avionics Bus 1Y Low |
| 53 | ZZ249A- | M22759/11-22-5 | Shield Ground |
| 54 | U502A-26 | 10595 | Avionics Bus 1X Low |
| 55 | A283A-26 | M27500A24RC1S | Spare |
| 56 | A293A-26 | M27500A24RC1S | Spare |
| 57 | A705A-26 | M27500A26RC2S | Launch Initiate A (Radar) |
| 58 | | M22759/11-22-5 | 28 Vdc No. 2 Power control Relay |
| 59 | | | Not Used |
| 60 | A309A-26 | M27500A26RC2S | AZ Right Station 8 |
| 61 | A279A-26 | M27500A26RC2S | AZ Left Station 2 |
| 62 | A265A-26 | M27500A26RC2S | AZ left |
| 63 | A905A-26 | 10595 | Primary Armament Bus Low |
| 64 | ZZ233A- | M22759/11-22-5 | Shield Ground |
| 65 | A909A-26 | 10595 | Secondary Armament Bus Low |
| 66 | A274A-26 | M27500A24RC1S | Spare |

TABLE 4-continued

61P-F001A PIN ASSIGNMENT

| Pin No | Wire # | Wire Type | Signal |
|---|---|---|---|
| 67 | ZZ58A-22 | M22759/11-22-5 | Shield Ground |
| 68 | A301A-26 | M27500A24RC1S | Spare |
| 69 | A1020A- | M27500A26RC2S | Equipment Ready B |
| 70 | | M22759/11-22-5 | 28 Vdc No. 2 Power control Relay |
| 71 | | | Not Used |
| 72 | A280A-26 | M27500A26RC2S | AZ Right Station 2 |
| 73 | ZZ64A-22 | M22759/11-22-5 | Shield Ground |
| 74 | A266A-26 | M27500A26RC2S | AZ Right |
| 75 | A904A-26 | 10595 | Primary Armament Bus High |
| 76 | A908A-26 | M27500A24RC1S | Secondary Armament Bus High |
| 77 | A284A-26 | M27500A24RC1S | Upper Threshold/FOV Station 2 |
| 78 | A294A-26 | M27500A24RC1S | Upper Threshold/FOV Station 3 |
| 79 | A312A-26 | M27500A24RC1S | Spare |
| 80 | A1020A- | | Shield Ground |
| 81 | | M22759/11-22-5 | 28 Vdc No. 2 Power control Relay |
| 82 | | M17/128-RG400 | Electrical Fuzing |
| 83 | | | Shield Ground |
| 84 | A289A26 | M27500A26RC2S | AZ Right Station 3 |
| 85 | A288A-26 | M27500A26RC2S | AZ Left Station 3 |
| 86 | A281A-26 | M27500A26RC2S | EL Up Station 2 |
| 87 | A282A-26 | M27500A26RC2S | EL Down Station 2 |
| 88 | A271A-26 | M27500A24RC1S | Upper Threshold/FOV |
| 89 | ZZ59A-22 | M22759/11-22-5 | Shield Ground |
| 90 | A302A-26 | M27500A24RC1S | Upper Threshold/FOV Station 7 |
| 91 | A346A-26 | M27500A24RC1S | FM MUX Bus |
| 92 | A1021A- | M27500A26RC2S | Equipment Ready A |
| 93 | | M22759/11-22-5 | 28 Vdc No. 2 Power control Relay |
| 94–96 | | | Not Used |
| 97 | A262A-26 | M27500A26RC2S | EL Down |
| 98 | ZZ60A-22 | M22759/11-22-5 | Shield Ground |
| 99 | A290A-26 | M27500A26RC2S | EL Up Station 3 |
| 100 | A313A-26 | M27500A24RC1S | Upper Threshold/FOV Station 8 |
| 101 | A310A-26 | M27500A26RC2S | EL Up Station 8 |
| 102 | A346A-SH | M22759/11-22-5 | Shield Ground |
| 103 | A726A- | M22759/11-22-55 | Aircraft Ground |
| 104– | | | Not Used |
| 108 | A263A-26 | M27500A26RC2S | EL Up |
| 109 | A291A-26 | M27500A26RC2S | EL Down Station 3 |
| 110 | A299A-26 | M27500A26RC2S | EL Up Station 7 |
| 111 | ZZ61A-22 | M22759/11-22-5 | Shield Ground |
| 112 | A311A-26 | M27500A26RC2S | EL Down Station 8 |
| 113– | | | Not Used |
| 118 | | M22759/11-22-5 | Wired but not used |
| 119 | A300A-26 | M27500A26RC2S | EL Down Station 7 |
| 120 | | M22759/11-22-5 | Wired but not used |
| 121 | | M22759/11-22-5 | Wired but not used |
| 122– | | | Not Used |
| 124 | | M22759/11-22-5 | Wired but not used |
| 125 | | M22759/11-22-5 | Wired but not used |
| 126– | | | Not Used |

TABLE 5

61P-V019A PIN ASSIGNMENT (Station 9)

| Pin No | Wire # | Wire Type | Signal |
|---|---|---|---|
| 1 | | | |
| 2 | | | |
| 3 | | | |
| 4 | | | |
| 5 | A882B-26 | M27500A26RC2S14 | Right/Left Reference |
| 6 | A318K-26 | M27500A26RC2S14 | Right/Left Reference |

TABLE 5-continued

61P-V019A PIN ASSIGNMENT (Station 9)

| Pin No | Wire # | Wire Type | Signal |
|---|---|---|---|
| | | | Return |
| 7 | | | |
| 8 | | | |
| 9 | A883B-26 | M27500A26RC2S14 | Acquisition Lambda |
| 10 | A318M-26 | M27500A26RC2S14 | Acquisition Lambda Return |
| 11 | A908L-22 | M22759/11-22-5 | Secondary Armament Bus High |
| 12 | A909L-22 | M22759/11-22-5 | Secondary Armament Bus Low |
| 13 | A884A-26 | M27500A26RC2S14 | Head Command |
| 14 | A318N-26 | M27500A26RC2S14 | Head Command Return |
| 15 | A904AT-26 | 10595 | Primary Armament Bus High |
| 16 | | | |
| 17 | | | |
| 18 | | | |
| 19 | | | |
| 20 | ZZ22A-22 | M22759/11-22-5 | Shield Ground |
| 21 | A905AT-26 | 10595 | Primary Armament Bus Low |
| 22 | ZZ71A-22 | M22759/11-22-5 | Shield Ground |

TABLE 5a

61P-U011A PIN ASSIGNMENT (Station 1)

| Pin No | Wire # | Wire Type | Signal |
|---|---|---|---|
| 1 | | | |
| 2 | | | |
| 3 | | | |
| 4 | | | |
| 5 | A882B-26 | M27500A26RC2S14 | Right/Left Reference |
| 6 | A318K-26 | M27500A26RC2S14 | Right/Left Reference Return |
| 7 | | | |
| 8 | | | |
| 9 | A883B-26 | M27500A26RC2S14 | Acquisition Lambda |
| 10 | A318M-26 | M27500A26RC2S14 | Acquisition Lambda Return |
| 11 | A908L-22 | M22759/11-22-5 | Primary Armament Bus High |
| 12 | A909L-22 | M22759/11-22-5 | Primary Armament Bus Low |
| 13 | A884A-26 | M27500A26RC2S14 | Head Command |
| 14 | A318N-26 | M27500A26RC2S14 | Head Command Return |
| 15 | A904AT-26 | 10595 | Secondary Armament Bus High |
| 16 | | | |
| 17 | | | |
| 18 | | | |
| 19 | | | |
| 20 | ZZ22A-22 | M22759/11-22-5 | Shield Ground |
| 21 | A905AT-26 | 10595 | Secondary Armament Bus Low |
| 22 | ZZ71A-22 | M22759/11-22-5 | Shield Ground |

TABLE 6

61P-A020A PIN ASSIGNMENT (Gun Decoder)

| Pin No | Aircraft Wire # | Wire Type | Signal |
|---|---|---|---|
| 1 | | | |
| 2 | | | |
| 3 | A901A-22 | 5M2619-22-2SJ | Fire Voltage Return |
| 4 | A900A-SH | | Shield Ground |
| 5 | | | |
| 6 | A899A-22 | M27500-22TE2T15 | Magnetic Speed Sensor |

TABLE 6-continued

61P-A020A PIN ASSIGNMENT (Gun Decoder)

| Pin No | Aircraft Wire # | Wire Type | Signal |
|---|---|---|---|
| | | | Return |
| 7 | A898A-SH | | Shield Ground |
| 8 | | | |
| 9 | | | |
| 10 | A905A-26 | 10595 | Primary Arm Bus Low |
| 11 | A904A-SH | 10595 | Shield Ground |
| 12 | | | |
| 13 | | | |
| 14 | A909D-26 | 10595 | Secondary Arm Bus Low |
| 15 | A908D-SH | 10595 | Shield Ground |
| 16 | | | |
| 17 | A727E22 | M22759/44-22-5 | 28 Vdc Master Arm (C&D) |
| 18 | | | |
| 19 | | | |
| 20 | A900A-22 | M27500-22TE2T15 | Firing Output |
| 21 | | | |
| 22 | | | |
| 23 | A898A-22 | M27500-22TE2T15 | Magnetic Speed Sensor |
| 24 | | | |
| 25 | A904B-26 | 10595 | Primary Arm Bus High |
| 26 | | | |
| 27 | A908D-26 | 10595 | Secondary Arm Bus High |
| 28 | A1171A-22N | M22759/35-22-5 | Aircraft Ground |
| 29 | | | |
| 30 | | | |
| 31 | | | |
| 32 | A1060A-22 | M27500-22TE2U00 | Last Round/Round Limit |
| 33 | A1061A-22 | M27500-22TE2U00 | Last Round/Round Limit Excit |
| 34 | A344B-26 | M22759/11-22-5 | Bit Indication Latch |
| 35 | A343B-26 | M22759/11-22-5 | Gun Encoder/Decoder On |
| 36 | | | |
| 37 | | | |

TABLE 7

Air Combat Training Interface Device Pin Assignment 61P-A246B

| Pin No | Aircraft Wire # | Wire Type | Signal |
|---|---|---|---|
| 1 | U501AK-22 | M22759/11-22-5 | Avionics Mux 1X High |
| 2 | U502AK-22 | M22759/11-22-5 | Avionics Mux 1H Low |
| 3 | ZZ337A-22 | M22759/11-22-5 | Shield Ground |
| 4 | U503AM-22 | M22759/11-22-5 | Avionics Mux 1Y High |

TABLE 7-continued

Air Combat Training Interface Device Pin Assignment 61P-A246B

| Pin No | Aircraft Wire # | Wire Type | Signal |
|---|---|---|---|
| 5 | U504AM-22 | M22759/11-22-5 | Avionics Mux 1Y Low |
| 6 | A909D-26 | 10595 | ACTID Data Output Low |
| 7 | A908D-26 | 10595 | ACTID Data output High |
| 8 | U505AF-22 | M22759/11-22-5 | Avionics Mux 2X High |
| 9 | U506AF-22 | M22759/11-22-5 | Avionics Mux 2X Low |
| 10 | ZZ336A-22 | M22759/11-22-5 | Shield Ground |
| 11 | U507AH-22 | M22759/11-22-5 | Avionics Mux 2Y High |
| 12 | U508AH-22 | M22759/11-22-5 | Avionics Mux 2Y Low |
| 13 | SW464N-22 | M22759/11-22-5 | EW Mux High |
| 14 | SW465N-22 | M22759/11-22-5 | EW Mux Low |
| 15 | ZZ221A-22 | M22759/11-22-5 | Shield Ground |
| 16 | U1163U-22 | M22759/11-22-5 | Avionics Mux 5Y High |
| 17 | U1164U-22 | M22759/11-22-5 | Avionics Mux 5Y Low |
| 18 | U1165U-22 | M22759/11-22-5 | Avionics Mux 5X High |
| 19 | U1166U-22 | M22759/11-22-5 | Avionics Mux 5X Low |
| 20 | A1413B-SH | 10595 | Shield Ground |
| 21 | A1413B-26 | 10595 | Equipment Ready-B |
| 22 | A1414B-26 | 10595 | Equipment Ready-A |

TABLE 8

Crossover Cable Connectors Part Numbers

| Aircraft Connector Reference # | Connector Part Number | Aircraft Connector Location |
|---|---|---|
| J2 | MS27656T13B35P | Air Combat Training Interface Device |
| 61P-A246B | MS27467T13B35S | Aircraft Wiring |
| 61P A020A (P) | MS27467T13B35S | Aircraft Wiring |
| 61P A020A (J) | MS27468T15B35S | Gun Decoder |
| 61P-F001A (P) | MS27467T25B35S D | Aircraft Wiring |
| 61P-F001A (J) | MS27468T25B35P D | Armament Computer |
| 61P-V019A (P) | MS27467T13B35S D | Aircraft Wiring |
| 61P-V019A (J) | MS27468T13B35P D | Wing Tip Decoder |

TABLE 9

Connector Wiring Publication Reference

| Aircraft Connector Reference # | Connector Part Number | NAVAIR Aircraft Wiring Publication # | Work Package/ Page Number |
|---|---|---|---|
| 61P-A246B | MS27467T13B35S | A1-F18AC-WRAM-020 | 533 11/53 |
| 61P A020A (P) | MS27467T15B35P | A1-F18AC-WRAM-020 | 532 11/52 |
| 61P-F001A (P) | MS27467T25B35S D | A1-F18AC-WRAM-020 | 532 14/22 |
| 61P-V019A (P) | MS27467T13B35S D | A1-F18AC-WRAM-040 | 552/4 |
| Wire Type List | | A1-F18AC-WRAM-000 | 004/5-12 |
| Armament Computer Input/Output | | A1-F18AE-740-500 | 012 00 |

TABLE 10

| WIRE TYPE DESCRIPTION | | |
|---|---|---|
| WIRE PART NUMBER | ALTERNATE NUMBER | WIRE DESCRIPTION |
| 5M2619-22-2SJ | M27500-22TE2T15 | 2 Conductor, Twisted, Shielded |
| 5M2619-22-2SJ | M27500-22TE2U00 | 2 Conductor, Twisted |
| 5M2619-22-2SJ | 5M2619-26A1SJ | 1 Conductor, Shielded |
| M17/175-00001 | M17/175-00001 | Coaxial Cable 50 ohm |
| M22759/11-22-5 | M22759/11-22-5 | 22 GA |
| M22759/33-26-0 | M22759/11-22-5 | 26 GA |
| M22759/35-22-5 | M22759/35-22-55 | 22 GA |
| M22759/44-22-5 | M22759/11-22-5 | 22 GA |
| M27500-26MT2G11 | M27500A26RC2S14 | 2 Conductor, stranded copper alloy, twisted shielded |
| ST5M1212-003 | ST5M1212-003 | Coaxial cable, twin conductor, 68 ohm |

What is claimed is:

1. An air combat training apparatus installed into a preexisting model F/A-18 aircraft electronics system that includes a gun decoder, an armament computer, and a wingtip station 1/9 decoder, each coupled to primary and secondary armament busses, the preexisting F/A-18 aircraft electronics system also including an aircraft instrumentation subsystem internal (AISI) input/output connector, the air combat training apparatus compromising:

a wingtip weapons training module to monitor simulated weapons firing by the F/A-18 aircraft;

an air combat training interface device (ACTID); and a crossover cable assembly interconnecting the wingtip weapons training module to the ACTID via the secondary armament bus while electrically isolating the secondary armament bus from the gun decoder, armament computer, and a wingtip station 1/9 decoder, the crossover cable assembly also coupling the ACTID to the AISI input/output connector;

the ACTID compromising a digital data processing module programmed to convey digital data signals between aircraft data systems coupled to the AISI input/output connector and the wingtip weapons training module by performing steps compromising:

monitoring data signals received on the AISI input/output connector;

extracting monitored data signals addressed to one or more predetermined addresses; and transmitting the extracted data signals to the wingtip weapons training module via the secondary armament bus.

2. The apparatus of claim 1, the digital data processing module being further programmed to reformat the extracted signals before transmitting the extracted data signals to the wingtip weapons training module.

3. The apparatus of claim 1, the crossover cable assembly including a first connector electrically coupling the AISI input/output connector to the digital data processing module.

4. The apparatus of claim 1, the crossover cable assembly further including a connector detachably coupled to the AISI input/output connector.

5. The apparatus of claim 1, where:

the digital data processing module includes multiple input/output conductors;

the crossover cable assembly includes:

a first interface electrically connecting a first group of the multiple input/output conductors to the AISI input/output connector; and a second interface electrically connecting a second group of the multiple input/output connectors to the secondary armament bus.

6. The apparatus of claim 5, where:

the first and second groups of input/output conductors are distinct from each other.

7. The apparatus of claim 5, where:

the second group of multiple input/output conductors includes an ACTID Data Out Low line and an ACTID Data Out High line.

8. The apparatus of claim 1, the crossover cable assembly including a first interface electrically coupling the gun decoder to the primary armament bus while electrically isolating the gun decoder from the secondary armament bus.

9. The apparatus of claim 1, the AISI connector being coupled to avionics busses that carry avionics data signals, where the digital data processing module is programmed such that the data signals transmitted to the wingtip weapons training module include avionics data signals extracted from the avionics busses.

10. The apparatus of claim 1, the crossover cable assembly comprising multiple conductive members.

11. The apparatus of claim 1, the crossover cable assembly including a second interface electrically coupling the armament computer to the primary armament bus while electrically isolating the armament computer from the secondary armament bus.

12. The apparatus of claim 1, the crossover cable assembly including a third interface electrically coupling the wingtip station 1/9 decoder to the primary armament bus while electrically isolating the wingtip station 1/9 decoder from the secondary armament bus.

13. The apparatus of claim 1, the digital data processing module being further programmed to convey digital data signals between aircraft data systems coupled to the AISI input/output connector and the wingtip weapons training module by performing steps comprising:

monitoring data signals received by the ACTID from the wingtip weapons training module via a path including the secondary armament bus and the crossover cable assembly;

extracting monitored data signals addressed to one or more predetermined addresses; and transmitting the extracted data signals to the AISI input/output connector.

14. An air combat training apparatus installed into a preexisting model F/A-18 aircraft electronics system that includes a gun decoder, an armament computer, and a wingtip station 1/9 decoder, each coupled to primary and secondary armament busses, the preexisting F/A-18 aircraft electronics system also including an aircraft instrumentation subsystem internal (AISI) input/output connector, the air combat training apparatus comprising:

a wingtip weapons training means for monitoring simulated weapons firing by the F/A-18 aircraft;

an air combat training interface device (ACTID); and crossover cable assembly means for interconnecting the wingtip weapons training means to the ACTID via the secondary armament bus while electrically isolating the secondary armament bus from the gun decoder, armament computer, and wingtip station 1/9 decoder, the crossover cable assembly means including means for coupling the ACTID to the AISI input/output connector;

the ACTID including digital data processing means being for conveying digital data signals between aircraft data systems coupled to the F/A-18 AISI input/output connector and the wingtip weapons training means by:

monitoring data signals received on the AISI input/output connector;

extracting monitored data signals addressed to one or more predetermined addresses; and transmitting the extracted data signals to the wingtip weapons training means via the secondary armament bus.

15. A method of installing an air combat training apparatus into a preexisting model F/A-18 aircraft electronics system that includes a gun decoder, an armament computer, and a wingtip station 1/9 decoder, each coupled to primary and secondary armament busses, the preexisting F/A-18 aircraft electronics system also including an aircraft instrumentation subsystem internal (AISI) module coupled to an AISI connector, the method comprising:

removing the AISI module;

installing a wingtip weapons training module to monitor simulated weapons firing by the F/A-18 aircraft, the wingtip weapons training module being installed at either of wingtip stations one or nine;

installing a first interface electrically coupling the AISI input/output connector to an air combat training interface device (ACTID) including a digital data processing module programmed to convey digital data signals between aircraft data systems coupled to the AISI connector and the wingtip weapons training module;

installing a second interface electrically coupling the digital data processing module to the secondary armament bus; and installing a crossover cable assembly electrically coupling the secondary armament bus to the wingtip weapons training module, the crossover cable assembly also electrically isolating the armament computer, gun decoder, and wingtip station 1/9 decoder from the secondary armament bus.

16. The method of claim 15, the digital data processing module including multiple input/output conductors, the installing of the first interface electrically coupling a first group of the multiple input/output conductors to the AISI connector; and the installing of the second interface electrically coupling a second group of the multiple input/output conductors to the secondary armament bus.

17. The method of claim 16, the first and second groups of input/output conductors being distinct from each other.

18. The method of claim 16, the second group of multiple input/output conductors including an ACTID Data Out Low line and an ACTID Data Out High line.

19. The method of claim 15, the installation of the crossover assembly including installation of a third interface electrically coupling the gun decoder to the primary armament bus while electrically isolating the gun decoder from the secondary armament bus.

20. The method of claim 15, the installation of the crossover assembly including installation of a fourth interface electrically coupling the armament computer to the primary armament bus while electrically isolating the armament computer from the secondary armament bus.

21. The method of claim 15, the installation of the crossover assembly including installation of a fifth interface electrically coupling the wingtip station 1/9 decoder to the primary armament bus while electrically isolating the wingtip station 1/9 decoder from the secondary armament bus.

22. A modification kit to adapt existing model F/A-18 aircraft electronics to receive an air combat training system, where the existing F/A-18 aircraft electronics includes a gun decoder, a wingtip station 1/9 decoder, an armament computer, avionics busses, an electronic warfare bus, a primary armament bus, and a secondary armament bus, and where the air combat training system includes an air combat training interface device (ACTID) and a wingtip air combat weapons training module installed at either of wingtip stations 1 or 9, the modification kit comprising:

a first interface coupling the ACTID to the avionics busses, electronic warfare bus, and secondary armament bus, the first interface additionally coupling the gun decoder to the primary armament bus while electrically isolating the gun decoder from the secondary armament bus;

a second interface coupling the armament computer to the primary armament bus while electrically isolating the armament computer from the secondary armament bus; and a third interface coupling the wingtip station 1/9 decoder to the primary armament bus and coupling the secondary armament bus to the wingtip air combat weapons training module while electrically isolating the secondary armament bus from the wingtip station 1/9 decoder.

* * * * *

UNITED STATES PATENT AND TRADEMARK OFFICE

CERTIFICATE OF CORRECTION

PATENT NO. : 5,992,290

DATED : November 30, 1999

INVENTOR(S) : Gayle P. Quebedeaux, et al.

It is certified that error appears in the above-identified patent and that said Letters Patent is hereby corrected as shown below:

In column 29 :

line 28, delete "compromising" and insert - - comprising - -;

line 36, delete the word "a";

line 39, delete "compromising" and insert - - comprising - -; and line 43, delete "compromising" and insert - - comprising - -.

Signed and Sealed this

Nineteenth Day of September, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,992,290
DATED : November 30, 1999
INVENTOR(S) : Gayle P. Quebedeaux, et al.

It is certified that error appears in the above-identified patent and that said Letters Patent is hereby corrected as shown below:

In column 29,line 21, delete the word "a";
line 28, delete "compromising" and insert - - comprising - -;
line 36, delete the word "a";
line 39, delete "compromising" and insert - - comprising - -; and
line 43, delete "compromising" and insert - - comprising - -.

In column 30, line 41, delete the word "a".

In column 31, line 11, delete the word "a";
line 28, after "the" delete "AISI" and insert - -F/A-18 AISI input/output - -.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*